US011459779B2

(12) United States Patent
Ballantyne

(10) Patent No.: US 11,459,779 B2
(45) Date of Patent: Oct. 4, 2022

(54) ROOF-ANCHORING SYSTEMS AND METHODS

(71) Applicant: Ballantyne Gear Inc., McKinney, TX (US)

(72) Inventor: Flent Ballantyne, McKinney, TX (US)

(73) Assignee: Ballantyne Gear Inc., McKinney, TX (US)

( * ) Notice: Subject to any disclaimer, the term of this patent is extended or adjusted under 35 U.S.C. 154(b) by 0 days.

(21) Appl. No.: 16/876,674

(22) Filed: May 18, 2020

(65) Prior Publication Data

US 2020/0277801 A1 Sep. 3, 2020

Related U.S. Application Data

(63) Continuation-in-part of application No. 15/906,113, filed on Feb. 27, 2018, now abandoned.

(51) Int. Cl.
*E04G 21/32* (2006.01)

(52) U.S. Cl.
CPC ..... *E04G 21/3276* (2013.01)

(58) Field of Classification Search
CPC ..... E04G 21/3276; A62B 35/0068
USPC ..... 248/925; 188/36
See application file for complete search history.

(56) References Cited

U.S. PATENT DOCUMENTS 2,422,865 A 6/1947 Tucker
2,682,694 A 7/1954 Kempkes
3,336,068 A 8/1967 Renfroe
3,734,241 A 5/1973 Hale
3,924,539 A 12/1975 Wladis
4,398,620 A 8/1983 Townsend
4,399,893 A 8/1983 Switzer
4,582,176 A 4/1986 Roberts
4,795,141 A 1/1989 Mulvaney
5,005,813 A 4/1991 Lawrence
5,033,146 A 7/1991 Fogarty et al.
5,036,949 A * 8/1991 Crocker ..... E04G 21/3276 182/3
D321,796 S 11/1991 Forrand
(Continued)

FOREIGN PATENT DOCUMENTS

DE 1852202 U 5/1962
DE 3445682 A1 6/1986
(Continued)

OTHER PUBLICATIONS

PCT International Search Report and Written Opinion, PCT/US2009/062695, dated May 19, 2010, 6 pages.
(Continued)

*Primary Examiner* — Kimberly T Wood
(74) *Attorney, Agent, or Firm* — Scheef & Stone, LLP; Robin L. Barnes

(57) ABSTRACT

Improved roof anchoring system configured as a non-penetrating fall protection system with no nails or screws damaging the roof and including simultaneously used multiple anchoring devices each with a connector pivotally attached to a corresponding axle and each preventing another device from moving away from the roof edge and tensioned with respect to such other device via a common tether. A stopper can be optionally used to keep a given anchoring device in place during installation of the anchoring system.

14 Claims, 28 Drawing Sheets

(56) References Cited

U.S. PATENT DOCUMENTS

| | | | | |
|---|---|---|---|---|
| 5,137,112 | A | 8/1992 | Nichols | |
| 5,361,558 | A | 11/1994 | Thornton et al. | |
| 5,427,209 | A | 6/1995 | Tannehill et al. | |
| 5,607,029 | A | 3/1997 | Beckham | |
| 5,730,246 | A | 3/1998 | Beard | |
| 5,848,783 | A | 12/1998 | Weissenborn | |
| 6,112,853 | A | 9/2000 | Beard | |
| 6,681,893 | B1 | 1/2004 | Coulson | |
| 6,817,066 | B1 | 11/2004 | Williams et al. | |
| 7,686,566 | B1 | 3/2010 | Murphy | |
| 7,926,132 | B2 * | 4/2011 | Jordan | A61G 1/00 5/626 |
| 8,038,106 | B2 | 10/2011 | Magno, Jr. et al. | |
| 8,096,384 | B2 | 1/2012 | Caylor et al. | |
| 8,292,030 | B2 * | 10/2012 | Ballantyne | A62B 35/0068 182/45 |
| 8,567,571 | B1 | 10/2013 | Neff et al. | |
| D720,278 | S | 12/2014 | Pinkall | |
| 9,248,323 | B1 * | 2/2016 | Larsen | E04G 21/3261 |
| 9,308,403 | B2 | 4/2016 | Strawder | |
| 9,744,387 | B1 | 8/2017 | Hung | |
| 9,924,753 | B1 | 3/2018 | Soto et al. | |
| 10,071,268 | B2 | 9/2018 | Gaines et al. | |
| 2005/0189171 | A1 * | 9/2005 | Bos | E04G 21/3276 182/36 |
| 2006/0054399 | A1 | 3/2006 | Dudschus | |
| 2006/0156645 | A1 | 7/2006 | Munday et al. | |
| 2007/0272485 | A1 | 11/2007 | Baake | |
| 2010/0108442 | A1 | 5/2010 | Ballantyne | |
| 2012/0097406 | A1 | 4/2012 | Silcox et al. | |
| 2012/0312633 | A1 * | 12/2012 | Massey | E04G 21/3276 182/3 |
| 2016/0194890 | A1 | 7/2016 | Landry | |
| 2017/0259090 | A1 * | 9/2017 | Gaines | A62B 35/0068 |
| 2018/0272163 | A1 | 9/2018 | Colorado | |
| 2019/0262635 | A1 | 8/2019 | Ballantyne | |

FOREIGN PATENT DOCUMENTS

| | | | |
|---|---|---|---|
| DE | 3719953 | A1 | 12/1988 |
| DE | 29820510 | U1 | 12/1999 |
| DE | 202009013795 | U1 | 2/2011 |
| EP | 1205219 | A2 | 5/2002 |
| GB | 2113285 | A | 8/1983 |
| GB | 2160571 | A | 12/1985 |
| GB | 2334292 | A | 8/1999 |
| JP | H10146397 | A | 6/1998 |
| JP | 2006102219 | A | 4/2006 |
| WO | 9949154 | A1 | 9/1999 |
| WO | 2006105837 | A1 | 10/2006 |
| WO | 2013125945 | A1 | 8/2013 |
| WO | 2013168839 | A1 | 11/2013 |

OTHER PUBLICATIONS

PCT International Search Report and Written Opinion, PCT/US2020/033547, dated Sep. 8, 2020, 16 pages.

Safefall Supply, G-Clamp Temporary Fall Protection System Demo Video, Jun. 6, 2018, https://www.youtube.com/watch?v=qRtAju9VYMw.

Grainger, Black Steel with Rubber Cam Mop and Broom Holder, 12 PK, Product Information, https://www.grainger.com/, 2019, 1 page.

PCT International Search Report and Written Opinion, PCT/US2021/032895, dated Sep. 3, 2021, 11 pages.

* cited by examiner

ROOF-ANCHORING SYSTEMS AND METHODS

CROSS-REFERENCE TO RELATED APPLICATIONS

This patent application is a continuation-in-part from the U.S. patent application Ser. No. 15/906,113 filed on Feb. 27, 2018, the disclosure of which is incorporated by reference herein.

RELATED ART

Different types and configurations of anchorages and anchorage systems are used for fall restraint, fall arrest, and rope access in construction, repair, inspection and other industries. Such systems are configured to prevent injury or death by restraining a person from falling and/or arresting a fall, and also used to assist with rope access.

For example, WO9949154 illustrates a safety system (for roof workers) that includes roof-fixing means adapted to be connected to a roof edge of one side of the roof along with a harness worn by a roof worker located on the opposite side of the roof. A safety rope is used to connect the harness to the roof-fixing means. The roof-fixing means may be structured as a roof anchor with a hook (which, in operation, hooks or fastens to the lower edge of the roof cladding or rooftop—such as metal sheet—or roofing tile). A clamping bolt fixes the roof anchor to the cladding.

U.S. Pat. No. 8,292,030 teaches an anchoring system in which the roof-fixing means may be structured as a wheeled "hook member" that is adapted to be mounted to an eave or similar roof structure. The described hook member has a tether affixed to the hook body. The shortcoming of the described design stems from the possibility that the hook member, once mounted on the roof, can possibly move or become dislodged if the tether attached becomes loose from stretching, incorrect installation, lack of proper maintenance or any other reason and then the hook body is pulled or otherwise abruptly moved from a pull or abrupt motion from the tether that is attached to the anchoring hook. If the anchoring hook body becomes dislodged, a user is vulnerable to the risk of a serious or fatal fall.

Known to-date systems and mechanisms of related art are rather complex and difficult to cooperate with the roof, while the preparation to employing these systems is time consuming and may cause permanent damage or unattractive modification to at least a portion of the roof.

SUMMARY

Embodiments of the invention provide a method for forming and maintaining a secure attachment to a sloped rooftop of a building and to prevent detrimental and/or damaging outcomes to persons and property, to include not using damaging fasteners such as nails and screws that damage the rooftop or building. This method includes a step of positioning a first wheeled roof-anchoring device at or near a first edge of the roof such that a first set of wheels with a corresponding first axle are located under and in a first tensioned contact with the first edge (while a second set of wheels with a corresponding second axle are in contact with and on the roof and a first connector pivotally attached to the second axle is under tension due to a first force pulling such first connector away from the second axle along—for example, up—the roof). Here, the first roof-anchoring device includes a first arched body having first and second ends, the first axle with the first set of wheels juxtaposed with the first arched body at the first end, the second axle with the second set of wheels juxtaposed with the first arched body at the second end, and the first connector. The method additionally includes a step of disposing a second wheeled roof-anchoring device near a second edge of the roof such that a third set of wheels with a corresponding third axle are located under and in a second tensioned contact with the second edge (while a fourth set of wheels with a corresponding fourth axle are in contact with and on the roof and a second connector pivotally attached to the fourth axle is under tension due to a second force pulling such second connector away from the fourth axle and along—for example, up—the roof). Here, the second roof-anchoring device includes a second arched body having third and fourth ends, the third axle with the third set of wheels juxtaposed with the second arched body at the third end, the fourth axle with the fourth set of wheels juxtaposed with the second arched body at the fourth end, and the second connector. Notably, the said first and second connectors are linked with a common single tether line under strain chosen to maintain the first and second tensioned contacts while preventing the first and third sets of wheels from moving away from first and second edges of the roof. A line thrower and throwline are used to place the common single tether line over the rooftop so the installer does not have to climb on the roof, unprotected from falls, in order to install the system.

Generally, the method may additionally include at least one of the steps of configuring said tether line such that the step of preventing the first set of wheels from moving substantially relative to the first edge of the roof is caused only or primarily by the tensioned contact of the third set of wheels with the second edge of the roof, and the step of preventing the third set of wheels from moving substantially relative to the second edge of the roof is caused only or primarily by the tensioned contact of the first set of wheels with the first edge of the roof;

disengaging at least one of the first and second wheeled devices from a stopper disposed below or under an axle of such at least one of the first and second devices to cause said stopper to fall from a corresponding edge of the roof;

attaching a connecting element or elements, which may include at least one tether line, between a user's harness and said common single tether line or a lifeline or an element of the user's harness to the lifeline to permit at least one of sliding and anchoring: anchoring of the respective element at any point along the common single tether line, any point defined between the connectors of the first and second roof-anchoring devices, and sliding of the respective element over and along the common single tether line from every first point of the common single tether line to every second point of the common single tether line, both the first point and the second point defined between the connectors of the first and second roof-anchoring devices; and attaching a first connecting element or elements, which may include at least one tether (such as a 3-foot lanyard or rope), between a user's harness and a second connecting element or elements, which may include at least one tether line (such as a lifeline) to permit sliding and anchoring: anchoring of the first connecting element or elements at any point along the second connecting element or elements, and sliding of the first connecting element or elements over and along the second connecting element or elements from every first point of the second connecting element or elements to every second point of the second connecting element or elements, and attaching the said second connecting element or elements to said common single tether line to permit anchoring and sliding of the second connecting element or elements: anchoring of the second connecting element or elements at any point along the common single tether line, any point defined between the connectors of the first and second roof-anchoring devices, and sliding of the second connecting element or elements over and along the common single tether line from every first point of the common single tether line to every second point of the common single tether line, both the first point and the second point defined between the connectors of the first and second roof anchoring devices.

The attachment of a first slidable and anchorable connecting element or elements from the harness to a second connecting element or elements, combined with the attachment of the second slidable and anchorable connecting element or elements of the second connecting element or elements to a common single tether line are significant, since a person that works at a high risk job, such as cleaning rain gutters or installing Christmas lights is required to work along the edge of the roof and is at a high risk of falls. Using a rope grab or similar device as an element of the first connecting element or elements (such as a 3 foot lanyard) to connect to the second connecting element or elements (such as a lifeline) and also using another rope grab or similar device as an element of the second connecting element or elements to connect to the common single tether line, with rope grabs or similar devices that will slide freely only in one direction, such that the user can only travel away from harm, (may include sliding the first connecting element or elements toward the common single tether line, up a slope or across a level plane) and will only go in the reverse direction with deliberate actions to the rope grab, a person can attach their second connecting element or elements (such as a lifeline) to—the common single tether line that is parallel to a roof edge, and using the slidable and anchorable element of the first connecting element or elements from the harness to the second connecting element or elements, he can adjust the length of his lifeline so he is able to reach the edge where he is working, without being able to exceed that distance and not be at risk of falling from this working edge. When a person working on the roof edge moves along the working roof edge, the second connecting element or elements, such as a lifeline, will slide along the tether line and will follow the person. However, if the user is working on a sloped roof edge, like a gable, he may have two fall hazards, he can fall off the edge where he is working and he can roll or slide down the slope and possibly fall off an edge that is axially connected to the roof edge where the user is working. The first connecting element or elements from the harness to the second connecting element or elements and the second connecting element or elements of the lifeline to the common single tether line will prevent the person from falling off the roof edge where the person is working and if the person starts to slide down the slope of the rooftop, parallel to the sloped roof edge, towards a roof edge that is axial to the sloped roof edge, the system will limit the distance the person can slide down the roof, to prevent the user from falling from a roof edge, or at least prevent the person from striking the ground if the fall is not prevented.

In one implementation of the method, the step of disposing (attaching a roof anchoring device to a roof of a building) includes disposing the first roof-anchoring device near or at the first edge of the roof. In a related and non-exclusive implementation, at least one of the steps of positioning and disposing includes at least one of the following: a) locating roof-anchoring device on the rooftop such that all wheels of such chosen device are in contact with a rooftop; and causing such chosen device to wheel to a corresponding edge of the roof, at least until a set of wheels of the chosen device closest to the corresponding edge loses contact with the roof b) repositioning the chosen device along a wall of the building up towards the rooftop until the wheels of an axle—to which a corresponding connector is attached—is positioned above the corresponding edge of the roof while a set of wheels on an axle opposite to the corresponding connector is under and pressing toward the edge of the roof; and c) pivoting the connector at the corresponding axle that is above the roof. Alternatively or in addition, the method may further include one of the following: i) after the steps of locating the anchoring device on the roof and causing at least one set of wheels to roll off the roof, wheeling the chosen roof-anchoring device up the roof to pull the set of wheels that has lost contact with the roof under the roof in a tensioned contact with the corresponding edge; and ii) wheeling the chosen device such that an axle at a side of the chosen device with the corresponding connector travels along the roof away from the corresponding edge to pull an axle that is opposite to the corresponding connector under the roof in the tensioned contact with the corresponding edge. Additionally, the step of locating may include placing a stopper on the roof between the corresponding edge and the axle closest to the corresponding edge; and engaging the wheels on said axle closest to the corresponding edge with the stopper to prevent further movement of the chosen device towards the corresponding edge. Furthermore, the step of causing may include removal of the stopper and wheeling the roof anchoring device to a corresponding edge of the roof, at least until a set of wheels of the chosen device closest to the corresponding edge loses contact with the roof;

Furthermore, the method may additionally include the step of positioning a third wheeled roof-anchoring device at or near a third edge of the roof such that a fifth set of wheels with a corresponding fifth axle are located under and in a third tensioned contact with the third edge (while a sixth set of wheels with a corresponding sixth axle are in contact with and on the roof and a third connector pivotally attached to the sixth axle is under tension due to a third force pulling the third connector away from the sixth axle, up the roof). Here, a structure of the third roof-anchoring device may be substantially equivalent to a structure of the first roof-anchoring device, and the third force is caused as a result of tensioned attachment of an element of the third roof-anchoring device to the common single tether line at a support point between the first and second roof-anchoring devices with the use of a supporting tether line (support line) that is transverse to the common single tether line. Alternatively or in addition, the method may include i) attaching a first connecting element or elements, which may include at least one tether line, between the user's harness and the common single tether line, and ii) attaching a second connecting element or elements, which may include at least one tether line, between the user's harness and said support line in order to permit at least one of: a) sliding of a respective element over and along the common single tether line from every point of the tether line to every other point of the tether line between an end of the tether line and a support point, and anchoring the respective element at the common single tether line between the end of the tether line and the support point; and b) sliding of the other respective element over and along the support line from every point of the support line to every other point of the support line between an end of the support line at the roof anchoring device and the support point at the common tether line, and anchoring the other respective element at the support line between the end of the support line at the anchoring device and the support point at the common tether line.

BRIEF DESCRIPTION OF THE DRAWINGS

Advantages of embodiments of the present invention will be apparent from the following detailed description of the several not-mutually-exclusive embodiments, which description should be reviewed with references to the accompanying drawings, in which:

FIGS. 24B and 24C are front and perspective views, respectively, showing a first roof anchoring device that is attached to a roof edge by a tensioned line. The line is tensioned to the first anchoring device by the weight of a roof anchoring device hanging from the opposite side and possibly also by the attachment of the user to the common single tether line by use of a connecting element or elements from the harness to the common tether line. The worker is lifting the roof anchoring device with a rope and a progress capture device or similar.

FIG. 26A shows the stop member coupled to (in operational juxtaposition with) an embodiment of the anchoring device, while

In the Drawings, generally, like elements and/or components may be referred to by like numerals and/or other identifiers; not all elements and/or components shown in one drawing may be necessarily depicted in another, for simplicity of illustrations.

DETAILED DESCRIPTION OF THE INVENTION

Figure 1A:
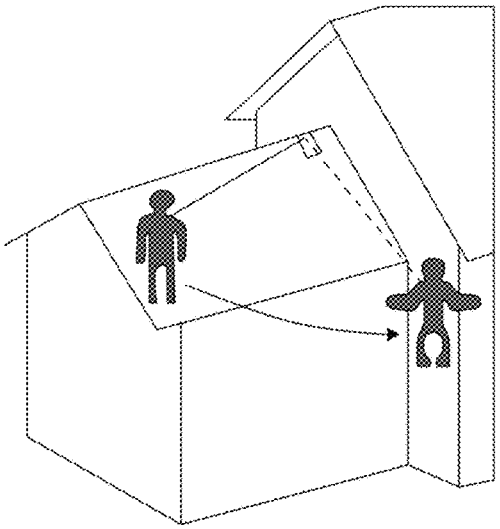
FIGS. 1A and 1B show the hazards of a swing fall related to a single point anchorage.
Figure 1B:
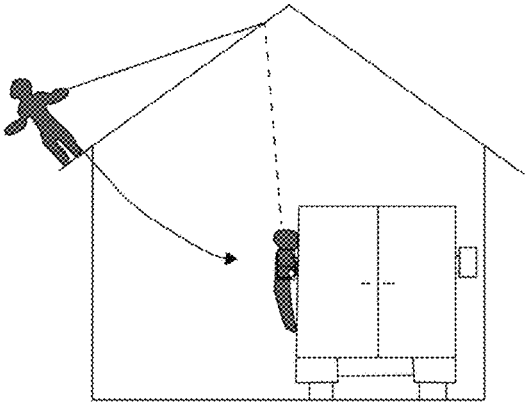

Roof-anchoring systems for sloped rooftops, such as residential-style sloped rooftops, of related art do not allow a worker on the rooftop to be, on the one hand, securely connected to the roof to prevent dangerous falls (including falling to the ground) causing injury or death and, on the other hand, to move about the roof, without creating a fall risk that may cause injury or death from hazards such as swing falls (examples of which are illustrated in FIGS. 1A and 1B). Additionally, most roof anchoring systems require penetration into the roof or the building so that if they are removed the structure is damaged and/or left with a hole.

Figure 2:
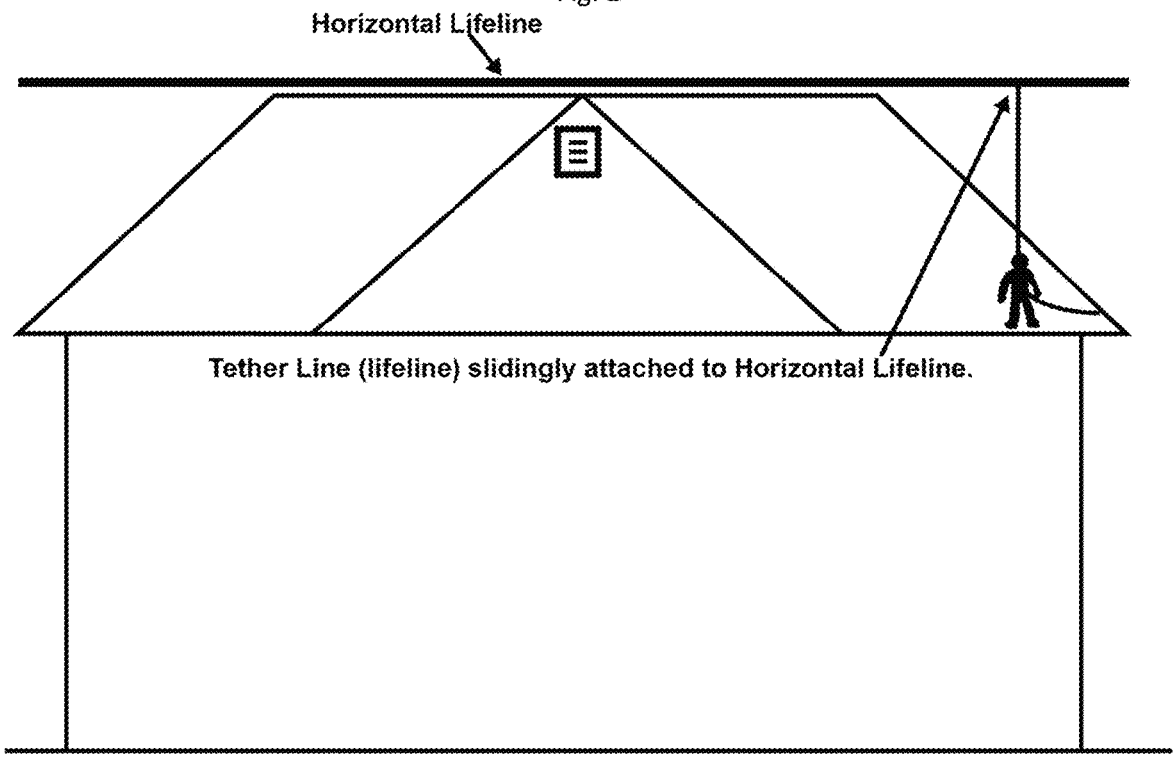
FIG. 2 is a front view of a horizontal lifeline following the ridge of a sloped roof and then extending above the slope, with a worker attached to a tether that is slidably attached to the horizontal lifeline.
Figure 3:
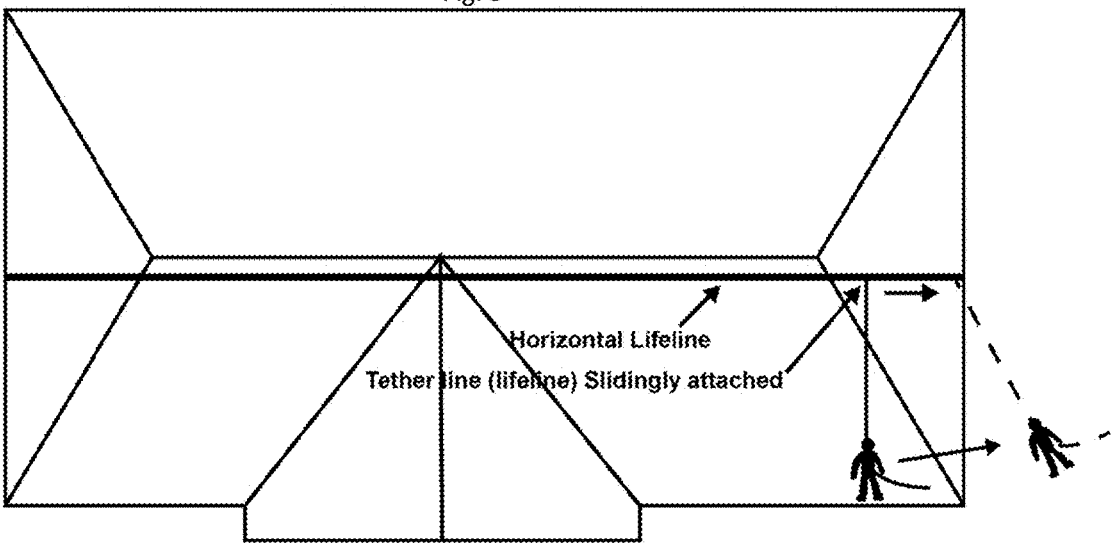
FIG. 3 is a top view of FIG. 2 showing a worker falling off the roof from a roof edge that is perpendicular to the horizontal lifeline and showing the tether sliding to the end of the horizontal lifeline. The sliding of the tether line along the horizontal lifeline is causing the fall distance to increase.
Figure 4:
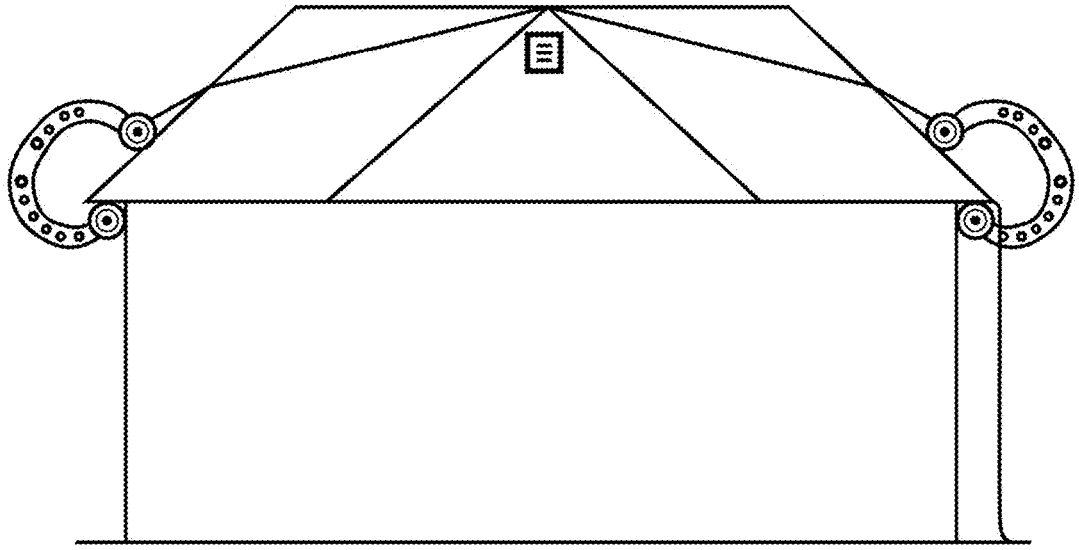
FIG. 4 is a front view of a tensioned common single tether line between a first and second roof anchoring device.
Figure 5:
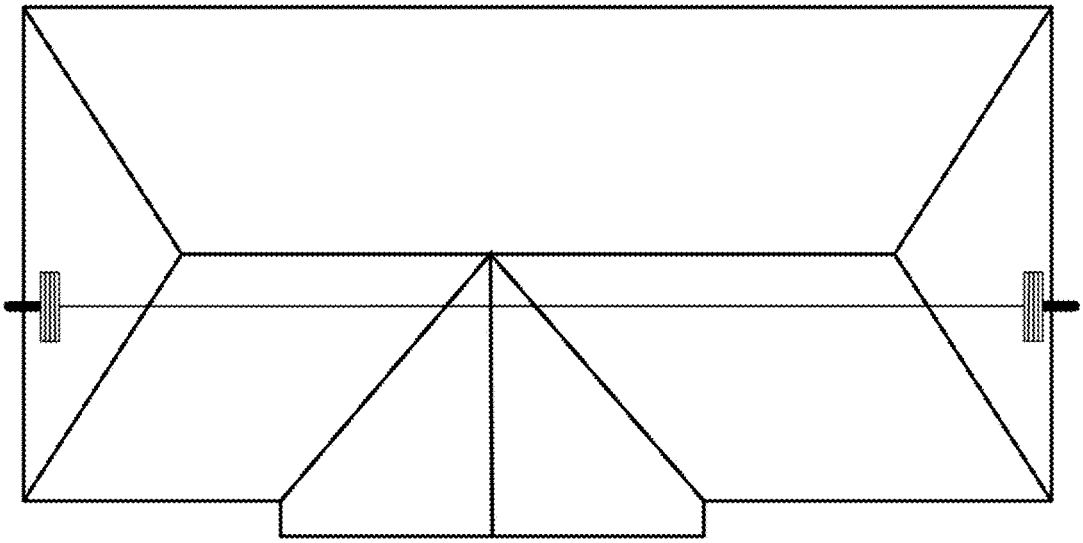
FIG. 5 is a top view of FIG. 4.
Figure 6:
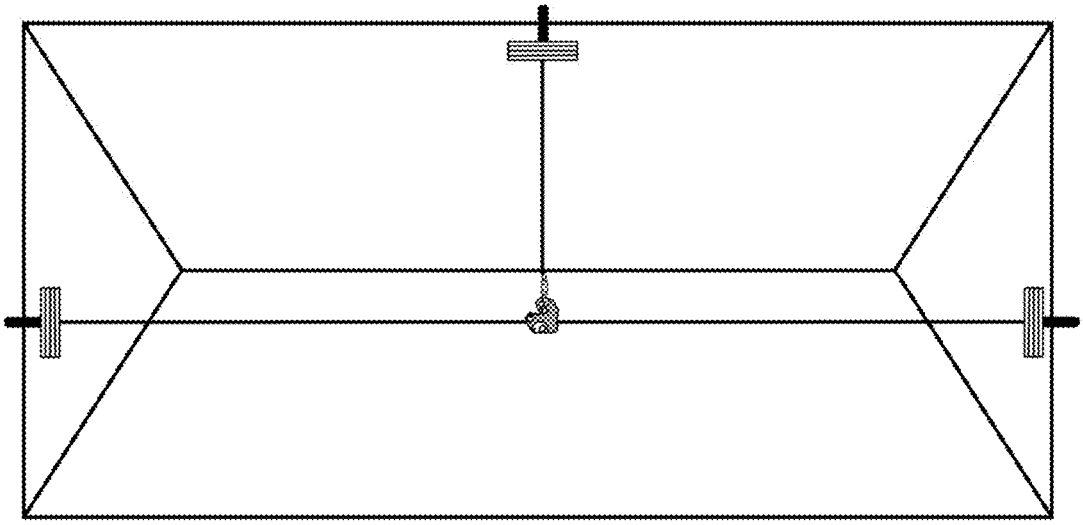
FIG. 6 is a top view showing a tensioned common tether line across the roof between two roof anchoring devices, plus a supporting tether line to the common tether line that is between a third roof anchoring device and the common tether line.
Figure 7:
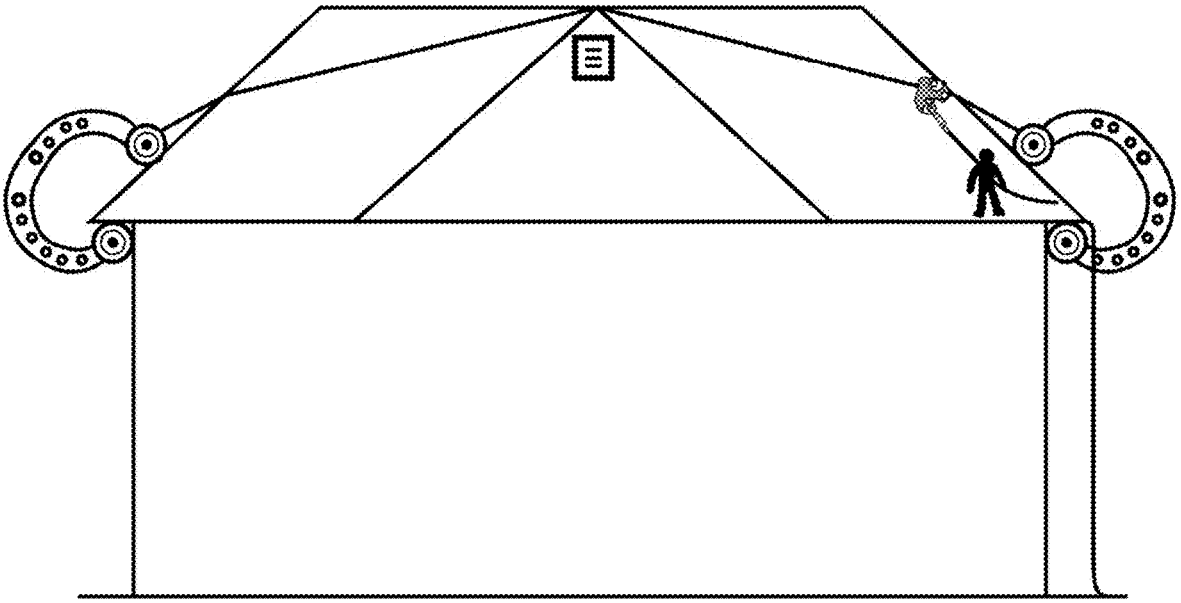
FIG. 7 is a front view showing a worker on a roof attached to the tensioned common tether line between two roof anchoring devices and using an element or elements that include at least one tether line that is/are slidable and anchorable to the tensioned tether.
Figure 8:
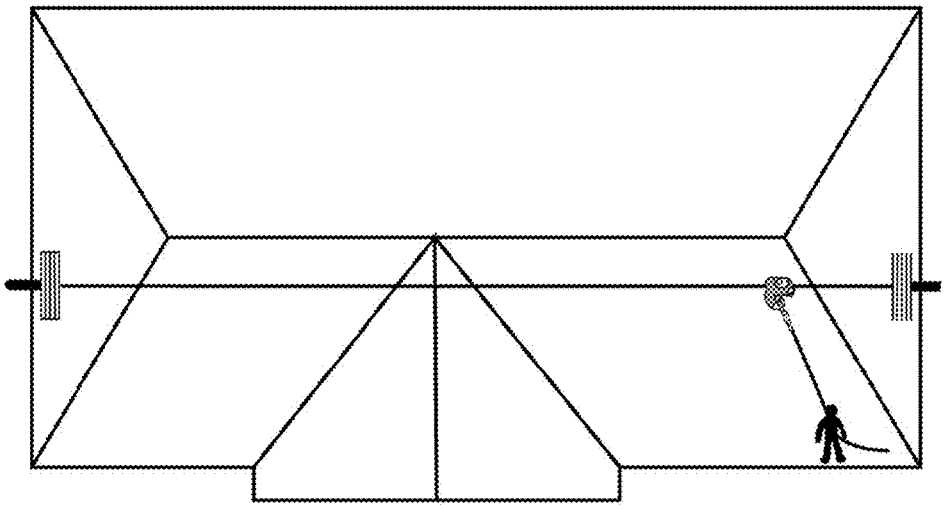
FIG. 8 is a top view showing a worker on a roof attached to the tensioned common tether line between two roof anchoring devices and using an element or elements that include at least one tether line that is/are slidable and anchorable to the tensioned tether.
Figure 9:
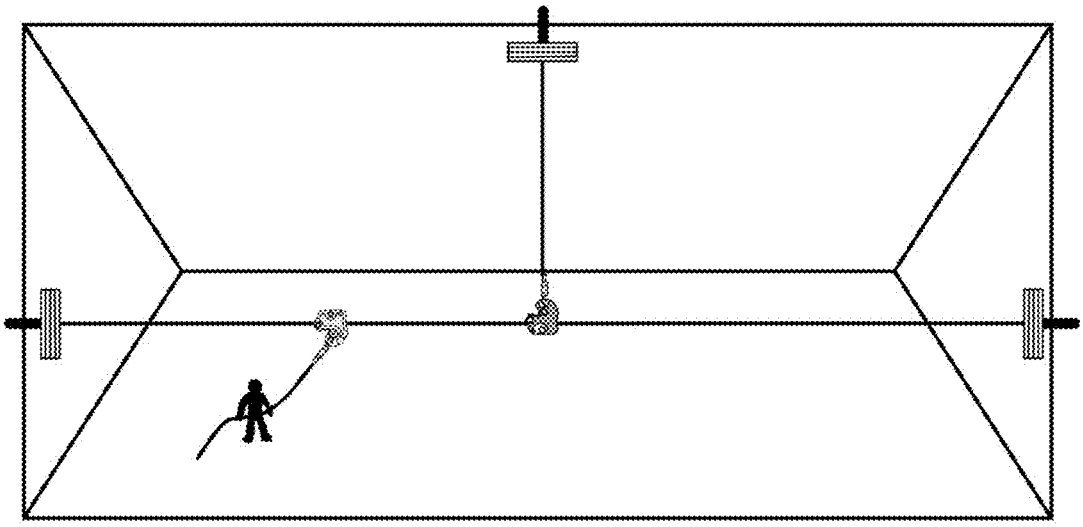
FIG. 9 is a top view showing a worker on a roof attached to the tensioned common tether line between two roof anchoring devices and using an element or elements that include at least one tether line that is/are slidable and anchorable to the tensioned common tether. Additionally, the common tether line is supported by a supporting tensioned tether line from a third roof anchoring device.
Figure 10:
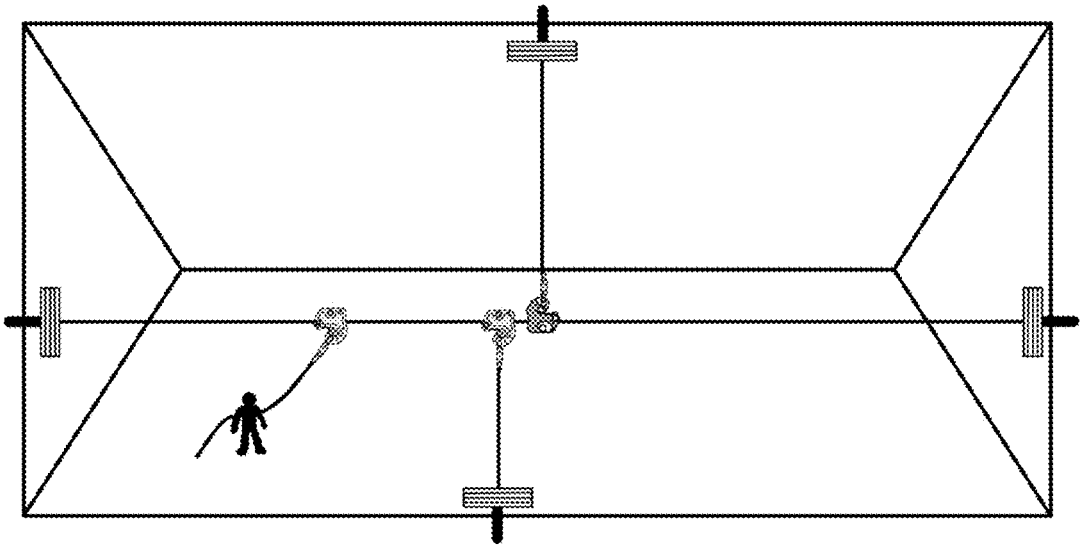
FIG. 10 is a top view showing a worker on a roof attached to the tensioned common single tether line between two roof anchoring devices and using an element or elements that include at least one tether line that is/are slidable and anchorable to the tensioned common tether. Additionally, the common tether line is supported by two tensioned tether lines, opposite each other, from a third and fourth roof anchoring device.
Figure 11:
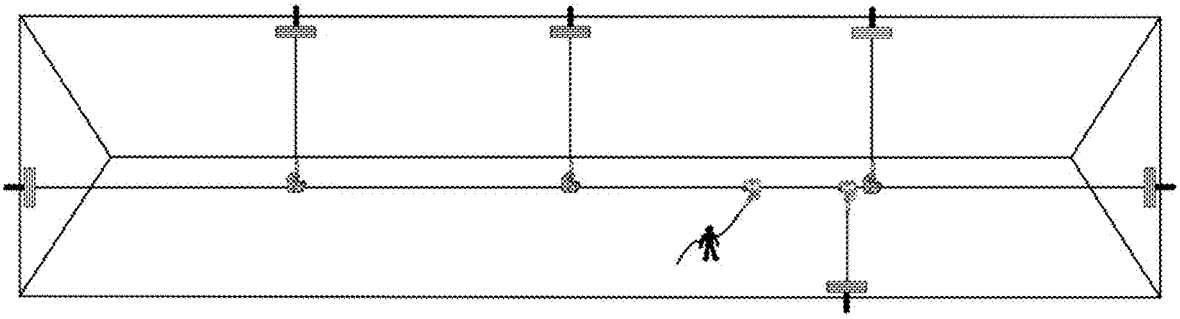
FIG. 11 is a top view showing a worker on a roof attached to the common single tensioned tether or fall protection system that has multiple support lines and using an element or elements that is/are slidable and anchorable to the tensioned tether.
Figure 12:
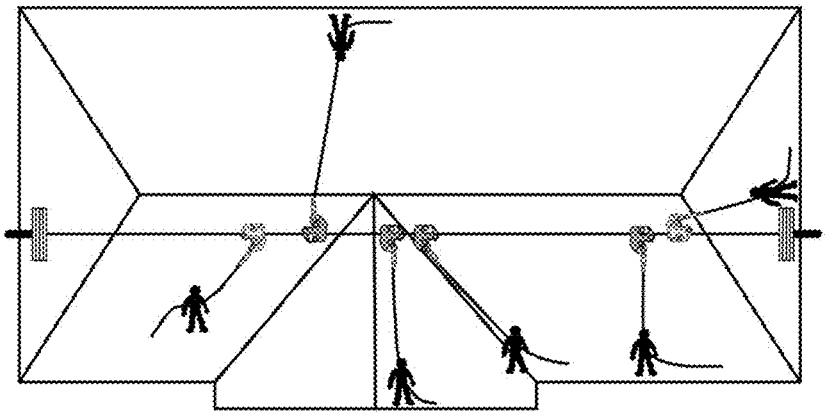
FIG. 12 is a top view showing multiple workers on a roof attached to the same tensioned common single tether or fall protection system and each one using an element or elements that is/are slidable and anchorable to the tensioned tether. All are in positions where they are inhibited from falling from the roof.

Horizontal lifelines are rarely used on most residential rooftops because the rooftops are not just horizontal, they are also sloped as seen in FIGS. 2 and 3. For example, if you are standing on a corner, prevented from a fall from one of the roof edges, using a horizontal lifeline (see FIG. 3), you are likely not protected from a fall from the other roof edge. And, if you fall from the roof edge that is subject to the fall hazard, a potentially dangerous swing fall could result. Additionally, during the fall, the attachment of the lifeline to the horizontal lifeline will likely slide to the end of the horizontal lifeline, resulting in increased fall distance and increased risk of injury and death. The problem of operationally-inadmissible dislodging of a roof anchoring device, mounted to the eave (or edge, or overhang portion) of the roof with one of its wheel axles under the eave, as a result of a movement of the common single tether line connected with such roof anchor at its opposite end. This problem is solved by tensionally straining a common single tether line, or a common single tether line with a supporting tether line or supporting tether lines, across the rooftop, with the tether line or lines attached to roof anchoring devices at the roof edges, as seen (for example) in FIGS. 4, 5, 6, and 10, with the tether lines generally following the pitches of the roof, creating continuous anchoring points for a lifeline that can attach to the tensioned tether line or lines and can freely slide along the tether line or lines and can anchor at any point on the tether line or lines, as seen (for example) in FIGS. 7, 8, 9, 10, 11, 12. Additionally, the user can attach to the lifeline such that the user can slide his attachment to the lifeline from any point to any other point on the lifeline and can anchor at any point on the lifeline. In one form such roof anchor is tensionally strained against a second roof anchor that has been also mounted to another eave of the roof to form a specific anchor assembly. Such anchor assembly is structured as a system of multiple anchor devices, the respectively-corresponding tether or tethers connecting two or more anchor devices, or tethers of which are substantially directly attached to one another at a predetermined location(s) with two or more anchor devices (configured according to the idea of the invention), with the common single tether line, or tether lines if supporting tether lines are included, along the rooftop between constituent anchors, each of which is meanwhile securely fastened to a corresponding eave of the roof due to tensile stress caused by its being connected to another anchor. Supporting tether lines can come from the sides of the common single tensioned tether line attaching axially to reinforce the original tensioned tether line and attached to another anchoring device. The location of a substantial direct attachment between the constituent, individual tethers (that, when attached to one another, form a network of joined tether lines) can be varied at the discretion of the user and might not be at the summit (ridge) of the roof—that is, at the top of roof slopes. As a result of attaching the tether line or lines of constituent anchors together substantially directly while avoiding and not forming a point of fastening of the common tether line with the roof, the user of the anchor assembly (a worker on the roof) gains an advantage of having a point of attachment of an element of the worker's connecting element or elements (lifeline) to the tether line (common tether line or supporting tether line, as used interchangeably herein) connecting the different anchors to be repositionably (for example, in a sliding fashion) moved along the such common tether line if desired. This may be achieved by removably attaching a user's lifeline element (a rope grab, or a similar device, for example) to the common tether line such as to allow this lifeline element to slidingly move along and over the common tether line to substantially any location of the common tether line between the constituent anchors while optionally avoiding a fixation of the lifeline element at any predetermined location, if preferred, or anchoring to any location along such line.

Notably, the formation of such common tether line does not prevent the user from additionally fastening the common tether line to the roof at substantially any point along the tether line, if desired, and change a location of such fastening when desired. In this specific case, the extent of relocation of the connecting element to the common tether line, along the common tether line, is defined by a stretch of the common tether line between a constituent anchor and the location of fastening. Attachments to the tether lines from other connections or obstacles may also stop the sliding relocation but methods can be used to transfer across these obstacles.

Figure 13:
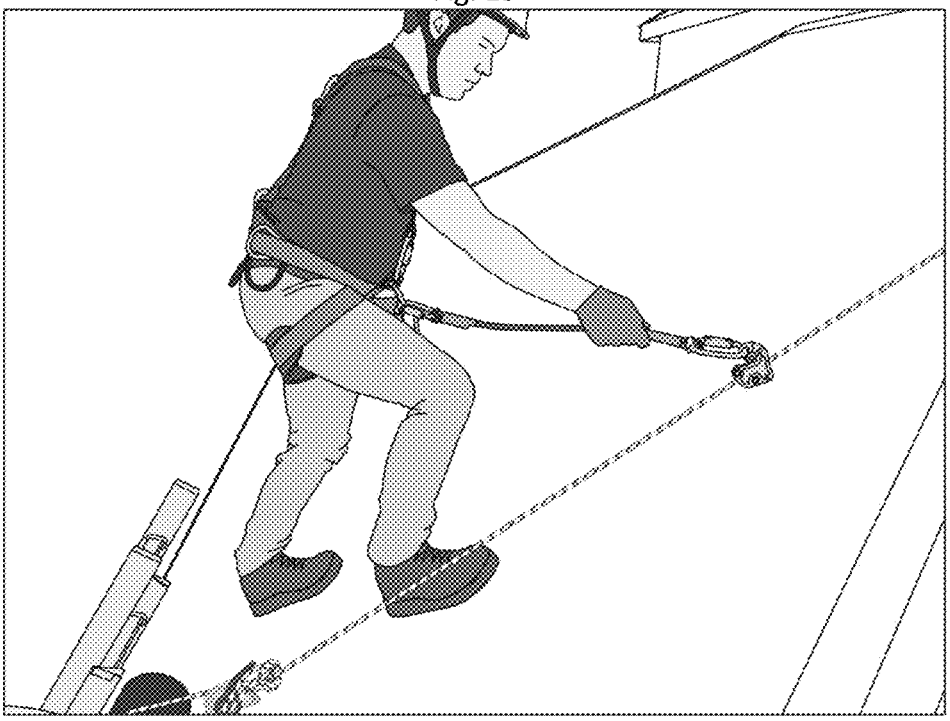
FIG. 13 is a perspective view of a worker that is attached to a tensioned tether with a connecting element or elements.
Figure 14:
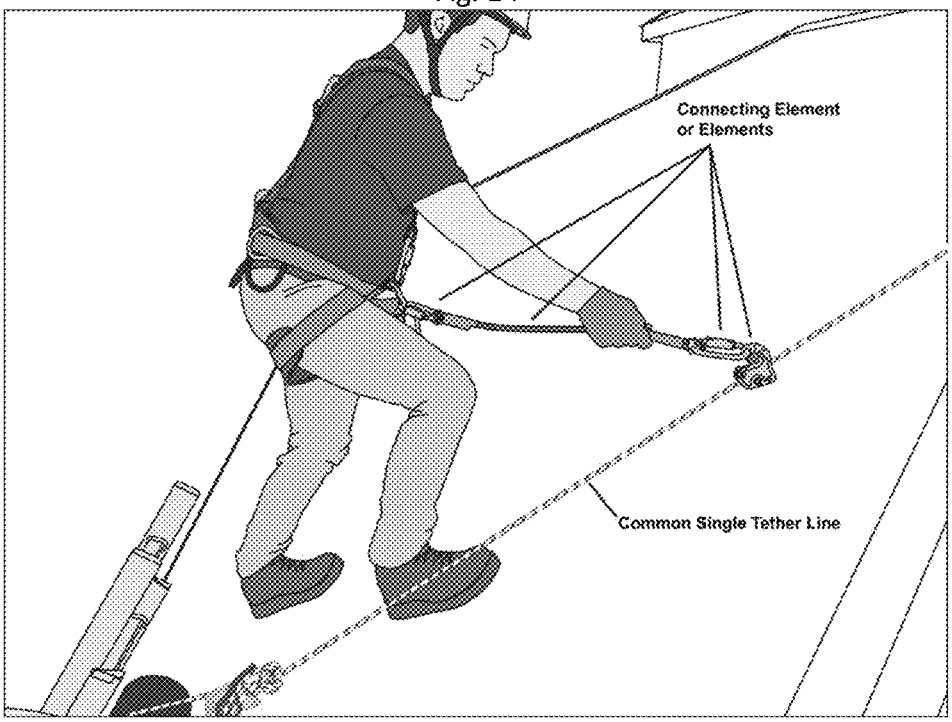
FIG. 14 is a perspective view of a worker that is attached to a tensioned tether with a connecting element or elements shown in FIG. 13 with the various components labeled.
Figure 15:
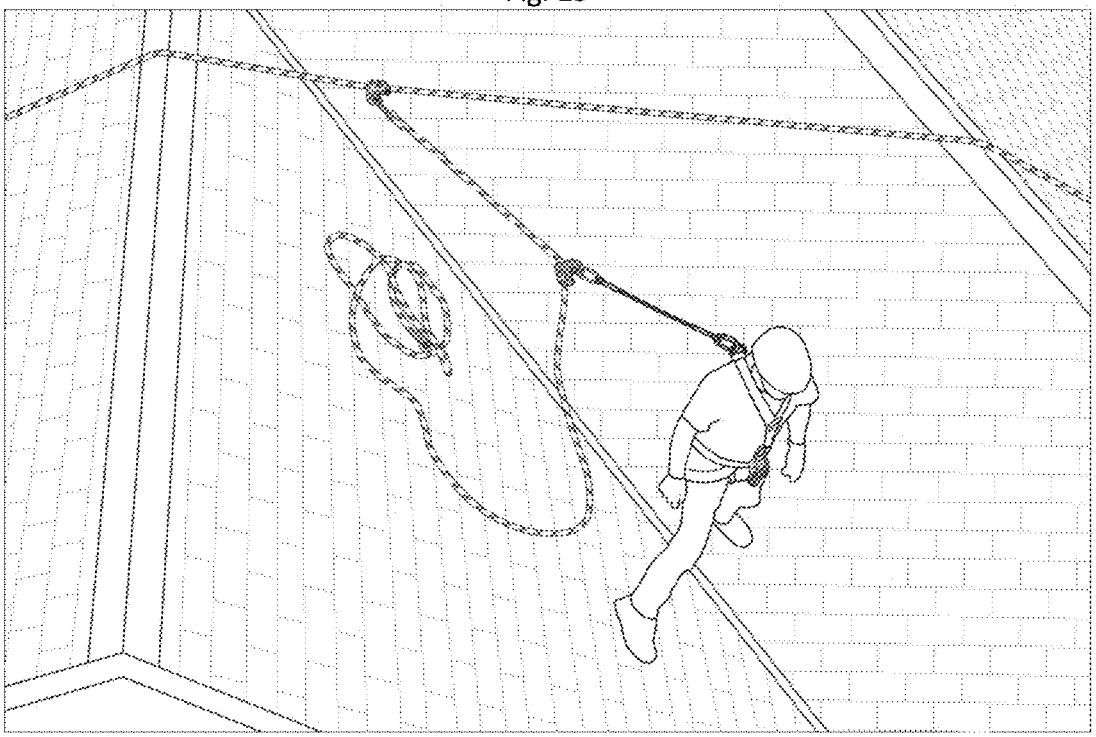
FIG. 15 is a perspective view of a worker that is attached to a tensioned tether with a connecting element or elements.
Figure 16:
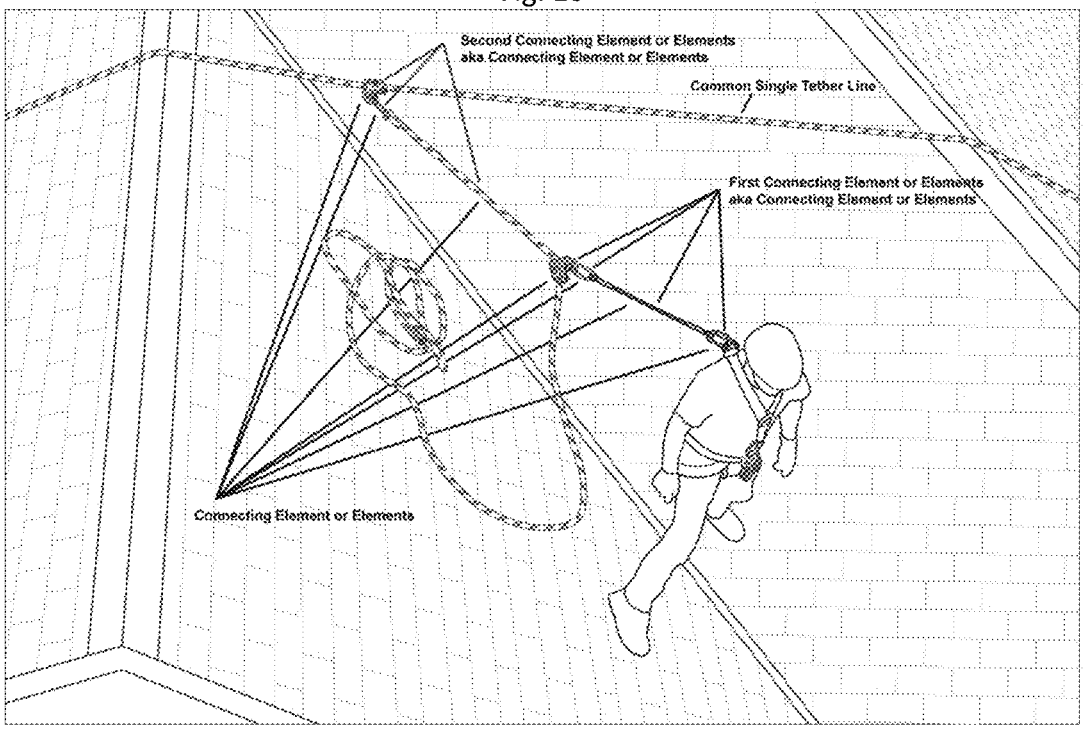
FIG. 16 is a perspective view of a worker that is attached to a tensioned tether with a connecting element or elements shown in FIG. 15 with the various components labeled.
Figure 29A:
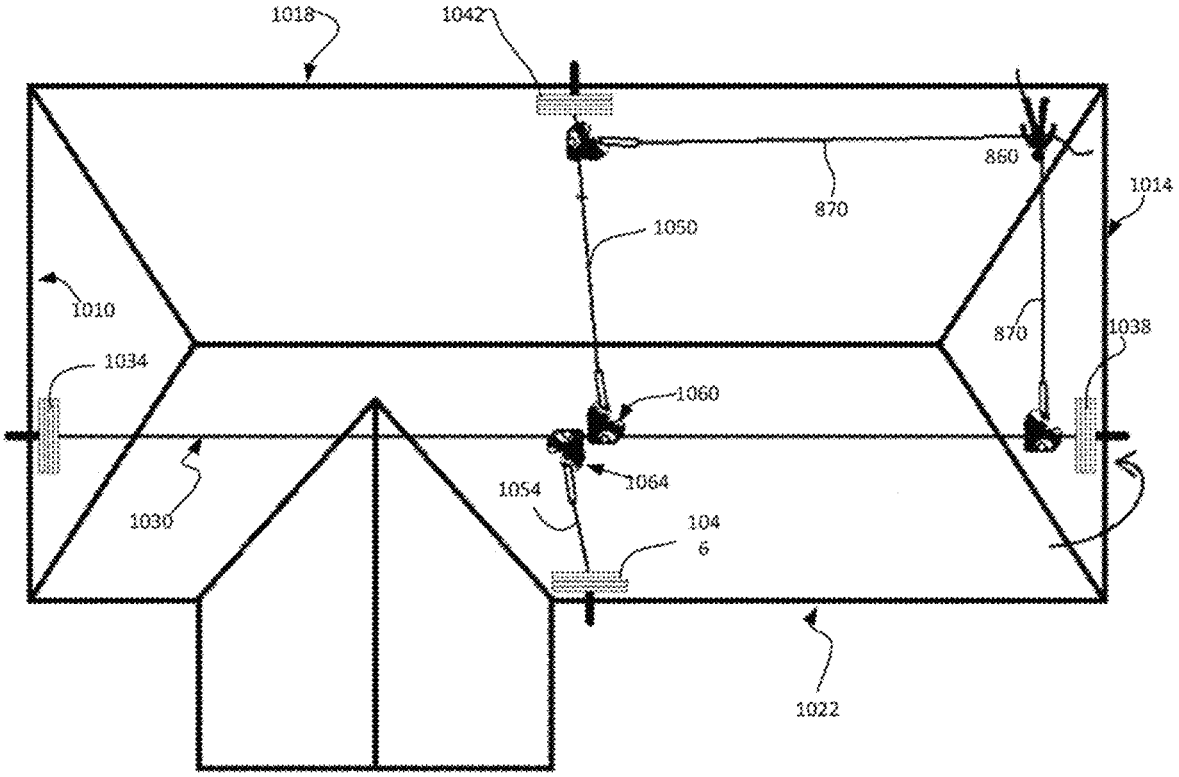
FIGS. 29A, 29B, 29C show different perspectives of non-limiting related implementation of the secure attachment to the rooftop.
Figure 29B:
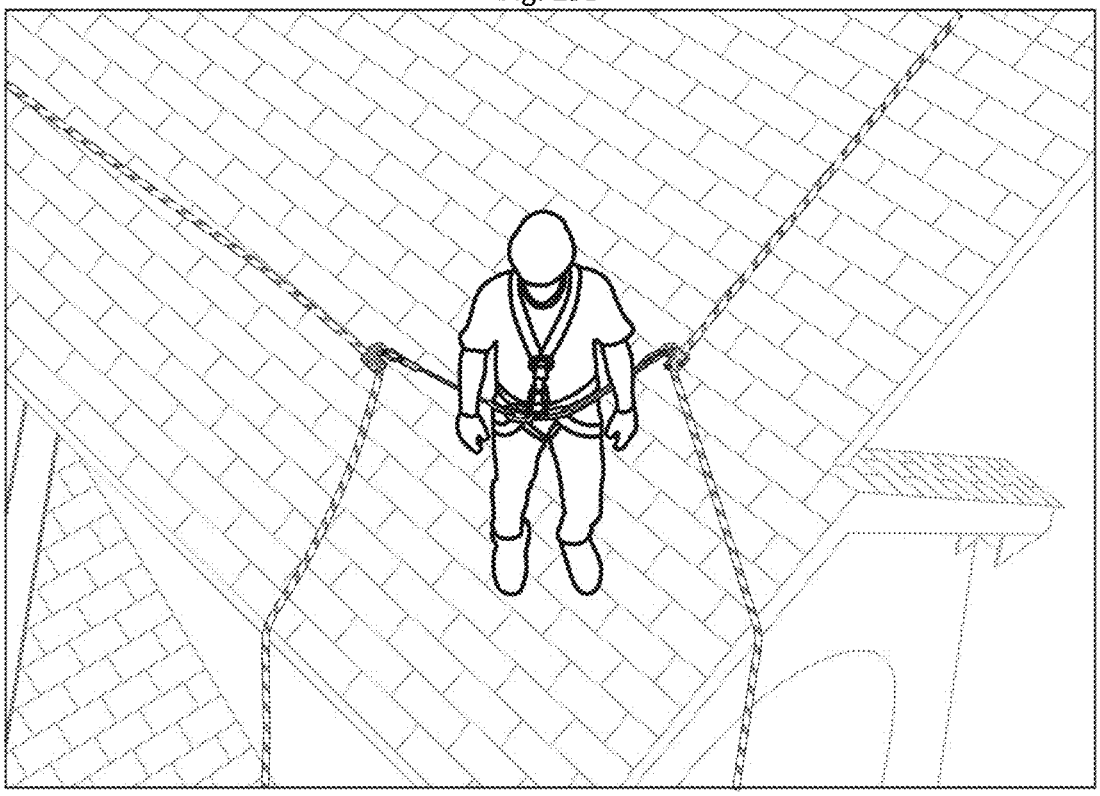
Figure 29C:
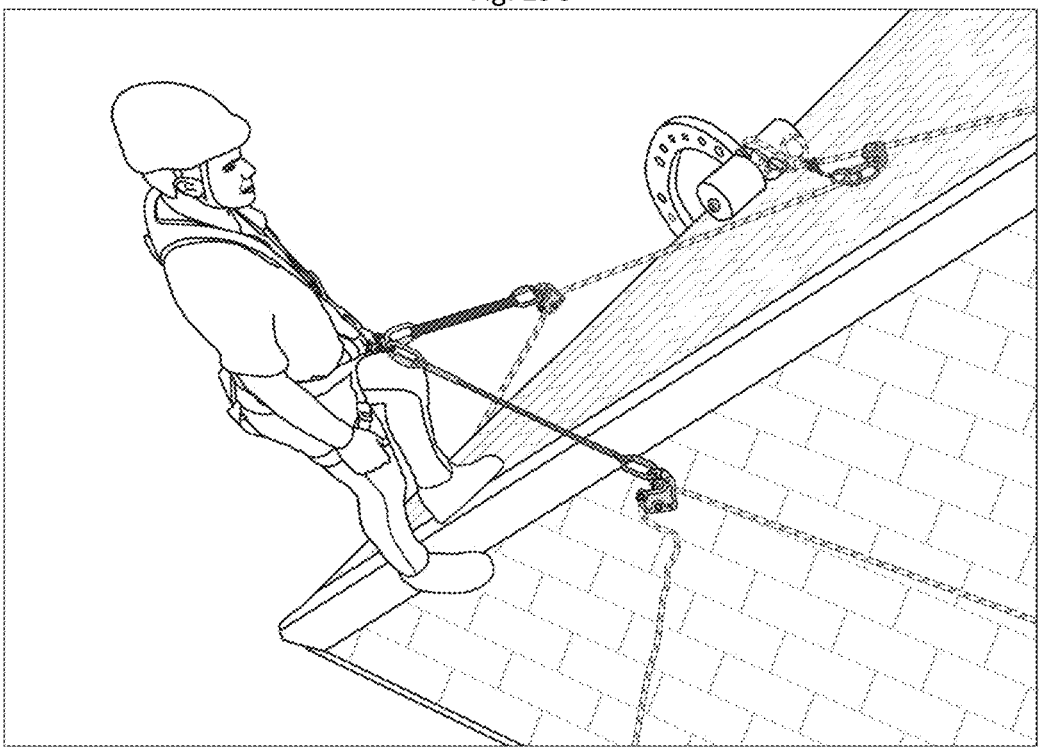

The user of the anchor assembly (a worker on the roof) gains an additional advantage of having a point of attachment of a connecting element or elements from his harness. Element or elements may include, for example, attachment of at least one tether line (such as a 3-foot lanyard or rope), shown in FIGS. 13 and 14, between a user's harness and said common single tether line to permit anchoring and sliding. Anchoring includes anchoring of the respective element at any point along the common single tether line, any point defined between the connectors of the first and second roof-anchoring devices. Sliding includes sliding of the respective element over and along the common single tether line from every first point of the common single tether line to every second point of the common single tether line, both the first point and the second point defined between the connectors of the first and second roof-anchoring devices. In another example, element or elements may include, for example, attachment of at least a first connecting element or elements from his harness, which may include at least one tether line (such as a 3-foot lanyard or rope) to a second connecting element or elements (such as a lifeline) to permit anchoring and sliding (see FIGS. 15 and 16). Anchoring includes anchoring of the first connecting element or elements at any point along the second connecting element or elements. Sliding includes sliding of the first connecting element or elements over and along the second connecting element or elements from every first point of the second connecting element or elements to every second point of the second connecting element or elements. In another example, element or elements may include, for example, attachment of said second connecting element or elements to said common single tether line to permit anchoring and sliding of the second connecting element or elements (see FIGS. 15 and 16). Anchoring includes anchoring of the second connecting element or elements at any point along the common single tether line, any point defined between the connectors of the first and second roof-anchoring devices. Sliding includes sliding of the second connecting element or elements over and along the common single tether line from every first point of the common single tether line to every second point of the common single tether line, both the first point and the second point defined between the connectors of the first and second roof anchoring devices. This may be achieved by removably attaching the said connecting element or elements, which may include at least one tether line (such as a 3' lanyard or rope) from a user's harness to the said common single tether line (possibly using a rope grab, or similar device, for example) (see FIGS. 13,14). This may also be achieved by removably attaching the said first connecting element or elements, which may include at least one tether line (such as a 3' lanyard or rope) from the user's harness to the second connecting element or elements, which may include at least one tether line, such as a lifeline, (possibly using a rope grab or similar device), and removably attaching the said second connecting element or elements to the said common single tether line (possibly using a rope grab or similar device (see FIGS. 15 and 16). The said first connecting elements and second connecting elements may also attach to supporting tether lines that support common single tether lines (see FIG. 29A, 29B, 29C).

The term "exemplary" when used herein is defined to mean "serving as an example, instance, or illustration." Accordingly, any embodiment referred to as "exemplary" is not to be construed as preferred or advantageous over other embodiments.

Figure 17:
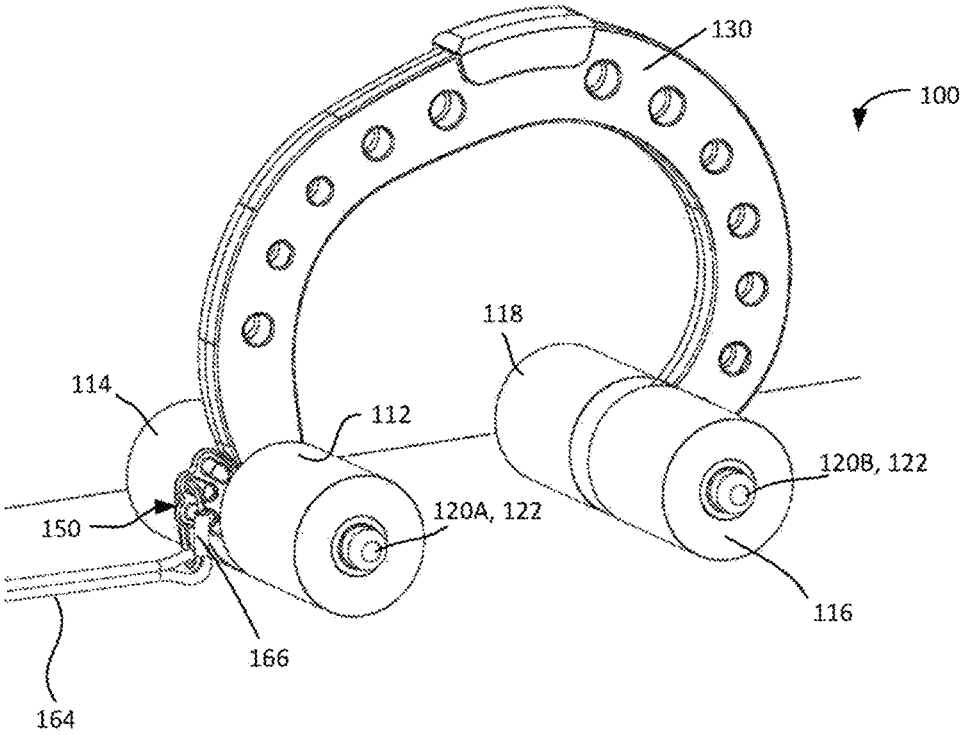
FIG. 17 is a perspective view of an improved wheeled roof-anchor or an "eave hook" system featuring a connector that is pivotally attached to an axle.
Figure 18:
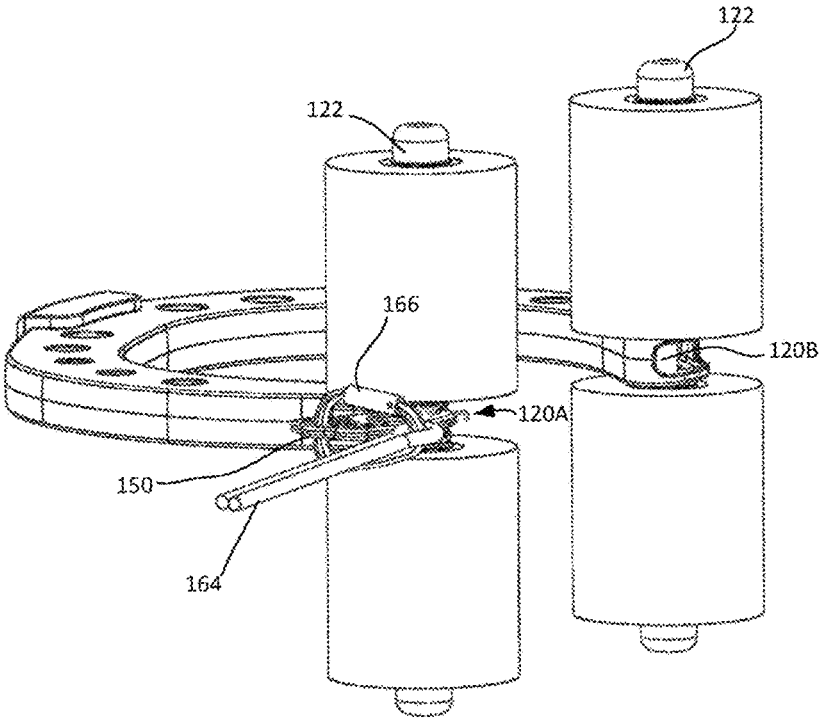
FIG. 18 is a bottom perspective view of the embodiment of FIG. 17.

To this end, FIGS. 17 and 18 illustrate an embodiment of a mobile "eave hook" device or anchor 100, shown in this example as having four wheels 112, 114, 116 and 118, arranged in two pairs on respectively-corresponding axles. (Depending on the specifics of a particular implementation, a different number of wheels and/or axles can be employed, with the wheel(s) and/or axle(s) defining, individually or in combination, an example lateral member that extends laterally from an arched anchor or lever or anchor body 130.) The wheels can generally be made of any desired materials such as rubber or plastic, for example, and may also have a surface configured to be slide-resistant.

Wheel axles 120A and 120B in one case can be capped with caps 122 and interconnected with one another through the arched anchor or lever or anchor body 130 that extends continuously from the axle 120A to the axle 120B, forming an open hook used for engaging a roof projection (for example, a roof eave) as discussed below. The arched anchor or hook 130 may be constructed of any relatively strong material such as steel, for example, and preferably dimensioned to form a generally asymmetrical "C" (with the curvature of the body 130 at one end being different from that at the other end). For example, as shown in FIG. 17, the end of arched anchor or hook 130 that attaches to wheel axle 120B is more curved than the end attached to the wheel axle 120A.

Figure 19:
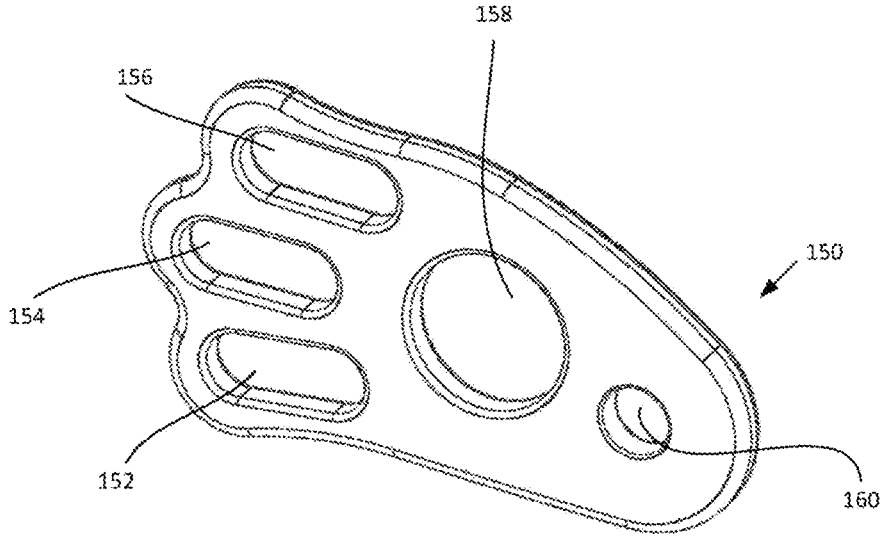
FIG. 19 is a perspective view of the embodiment of the connector depicted in FIGS. 17 and 18.

Now in reference to FIGS. 17, 18, and 19, the embodiment of the anchoring device is equipped with a connector 150 (which is including multiple through openings 152, 154, 156, 158, 160) that is pivotally attached to an axle (as shown—to axle 120A) through and at one of the openings of the connector 150—to which a tether 164 (a strap, a rope, a rod, a cord, a chain, for example) or another connector or different device may be attached directly or indirectly, and preferably to the opening that is closest to the roof when installed.

As shown in FIGS. 17 and 18, the tether 164 may be optionally removably coupled with the connector 150 of the anchoring member 100 via at least one snap hook, carabiner, tensioner, or similar intermediate link/s 166 (which may then be, in turn, optionally removably connected to the pivotally attached connector 150. However, it may also be desirable to couple the tether 164 directly to the axle. In other forms, it may be desirable to couple the tether 164 directly to the connector 150 without the use of intermediary link(s). Analysis of practical use and operation of the embodiment 100 for the purposes of securing a user on the roof has shown that utilizing the connector 150 pivotally-attached to and on the axle 120A in conjunction with the tether 164 or the combination of the tether 164 with the intermediate link 166 removes the risk of pulling or otherwise dislodging the device 100 anchored to the roof, away from the location at which the device 100 is attached to an eave or similar structure, as a result of a sudden and moderate to large force applied to an attachment of the tether to the body of the anchoring device, above the set of wheels that are sitting on the rooftop within an installed anchoring system where the wheels that are below the soffit are hanging a few inches below the soffit, as a result of improper installation, relaxing of the ropes without proper maintenance or other reasons. At on-site testing of a design currently used in related art, a wheeled anchor, as described above, was detached several times by a person, standing on the roof, pulling the tether upwards at an angle similar to a 14:12 slope in the direction of a force that would be caused by a fall from a person attached to the system on the opposite side of the roof. Understandably, eliminating this risk is critically important for the practical use of the roof anchor, as a fall from the roof may cause at a minimum serious injuries.

Figure 20:
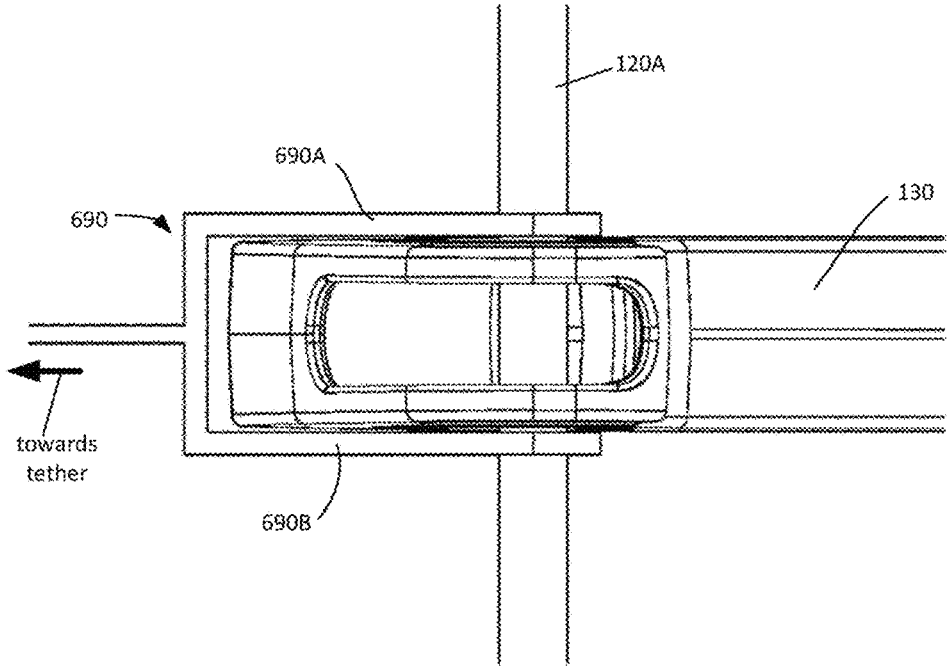
FIG. 20 provides a bottom view of a related embodiment of a connector of the roof-anchoring device, that is attached to an axle of the anchoring member in two places (for clarity, the wheels are not shown on the axle in FIG. 20).

(In a related implementation of the connector configured to be pivotally attached to the axle of the device 100—such as that of the connector 690 schematically illustrated in FIG. 20 in cooperation with the axle 120A—the connector 690 is judiciously configured to be a bracket with two arms 690A, 690B. Such bracket is dimensioned to embrace and go around the end of the anchoring device body 130, (shown attached to the axle 120A) to be movably affixed to the axle 120A in two places, through two respective openings in the arms 690A, 690B. The specific shape and features of the embodiment of the connector (intermediate link) 690 may differ—for example, the connector can include more than two openings for attachment to an axle (as would be, for example, in the case when the connector is configured to have an "M" shape for attachment to the axle at three locations).

As shown in the example of FIG. 19, the connector 150 may include a plurality of openings that facilitate attachment to other auxiliary connectors, tethers, and devices that may be used in conjunction therewith.

Figure 21A:
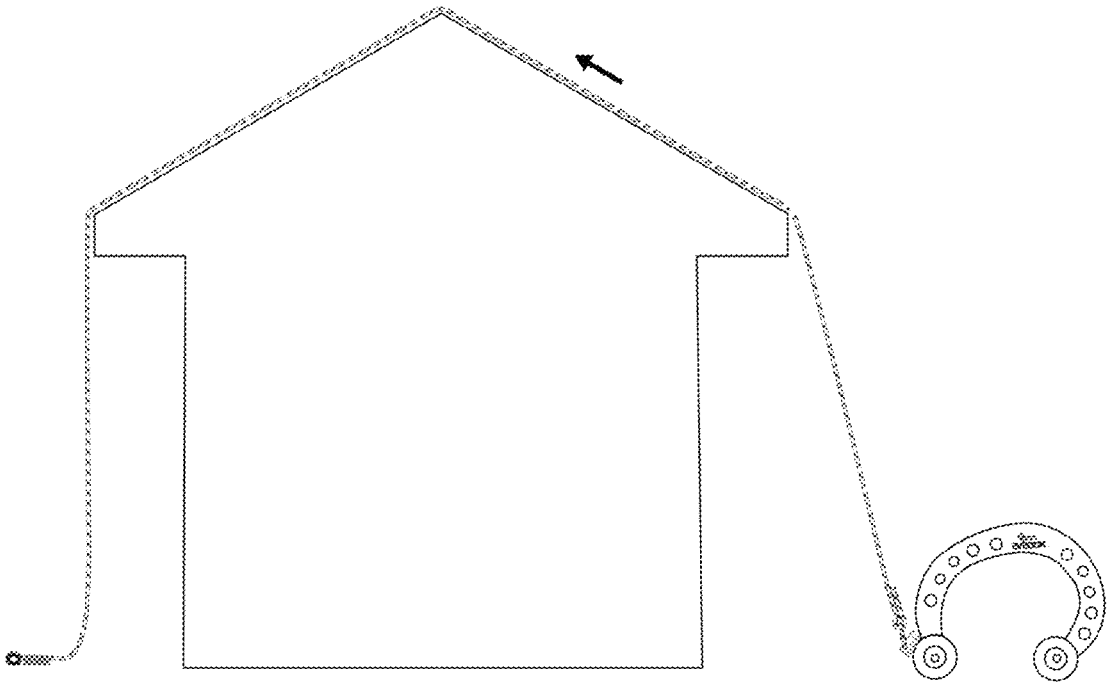
FIG. 21A is a front view showing an example of the roof anchoring device on the ground attached to a tether that crosses the roof and goes to the ground on the other side.
Figure 21B:
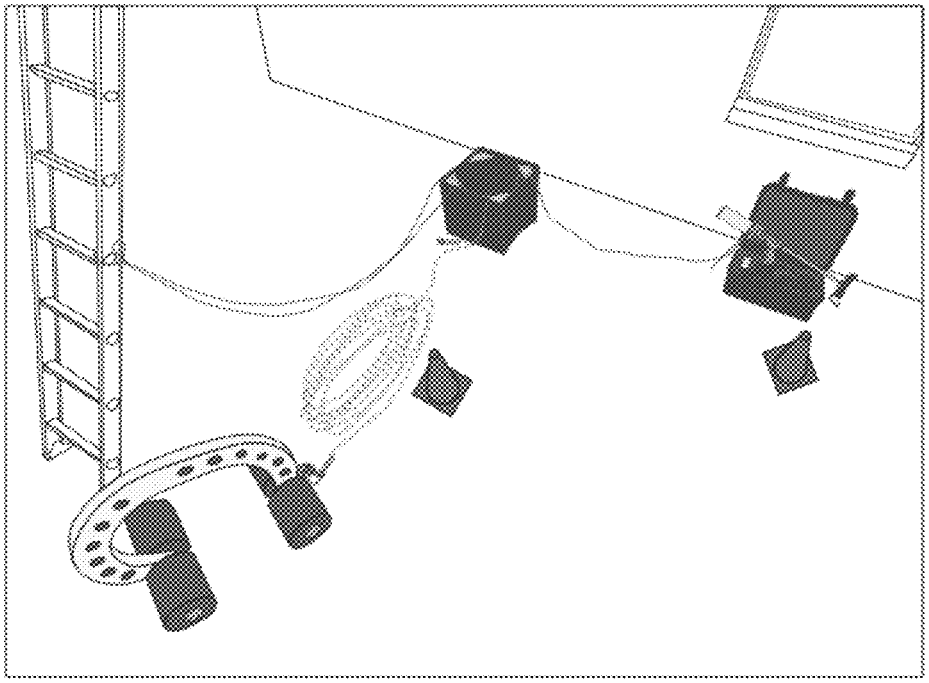
FIG. 21B is a perspective view of an example of a line-thrower with a projectile that is attached to a line, which is attached to a rope that is attached to the roof anchoring device.
Figure 21C:
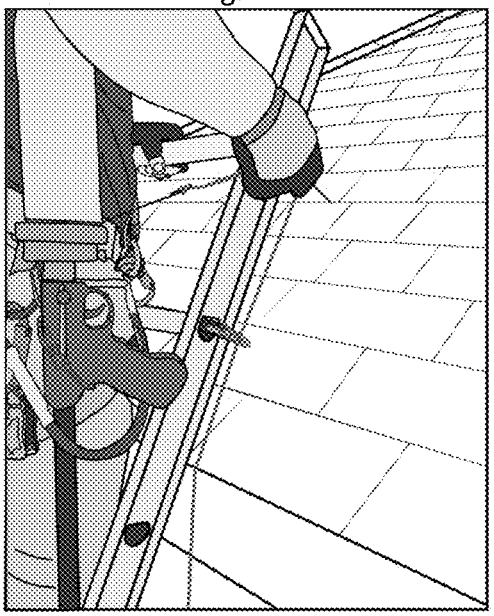
FIG. 21C is a perspective view of a worker that is at the top of the ladder with the line-thrower that is attached to a projectile that is attached to the throwline.
Figure 21D:
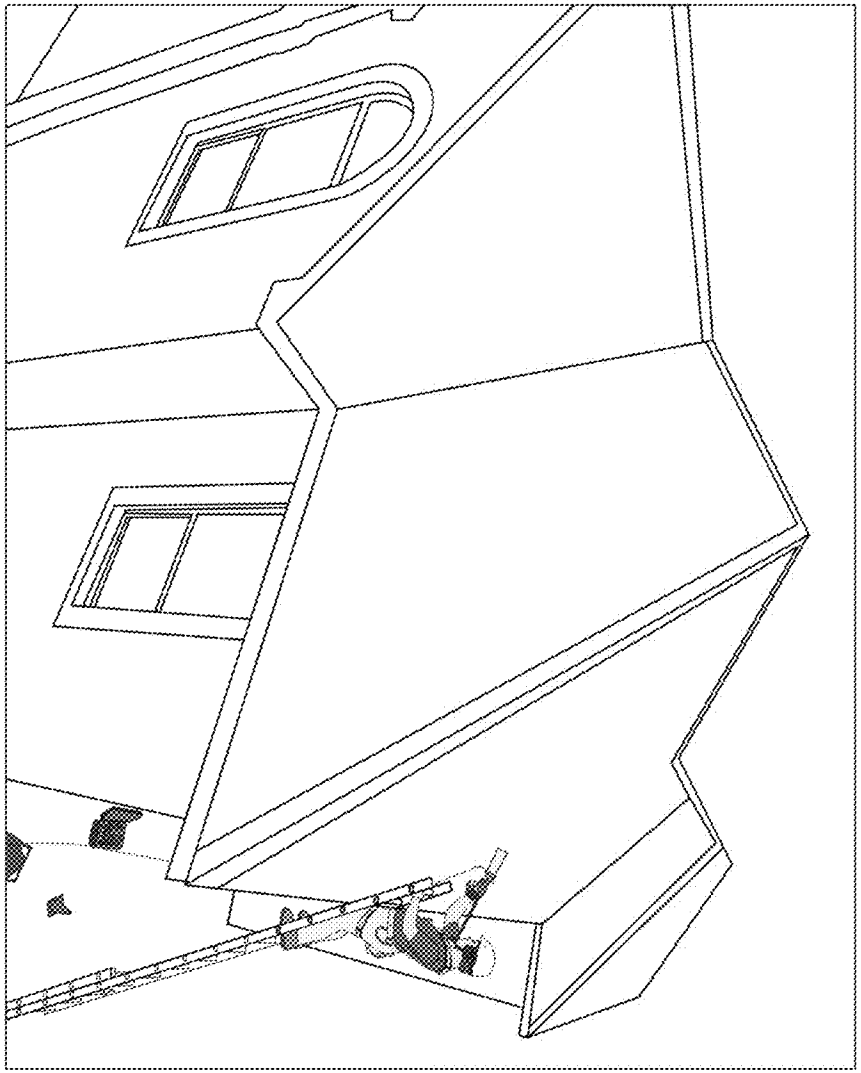
FIG. 21D is a perspective view of a worker that is ready to launch throwline across the roof.
Figure 22A:
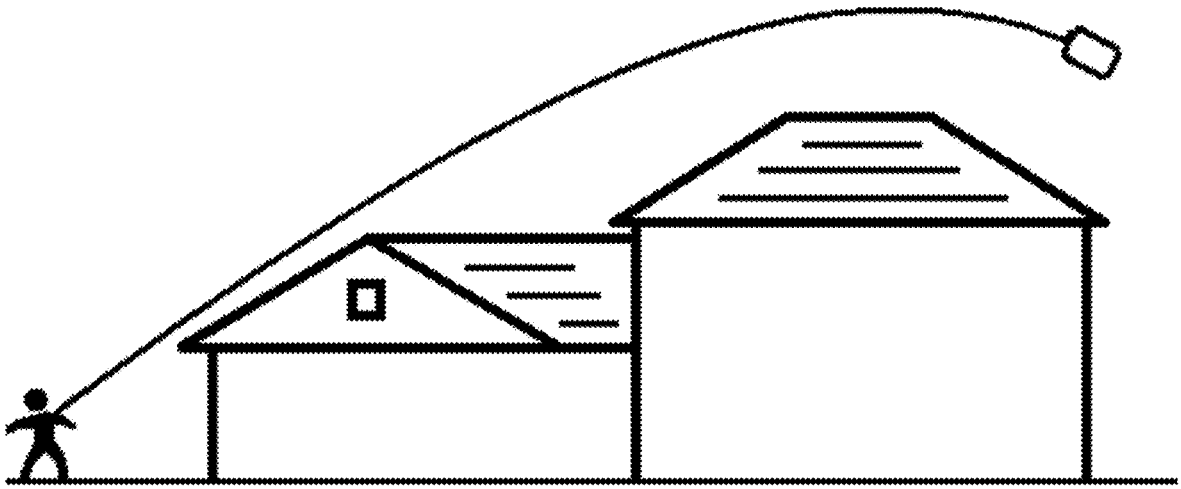
FIG. 22A is a front view showing a worker that is launching a throwline from the ground.
Figure 22B:
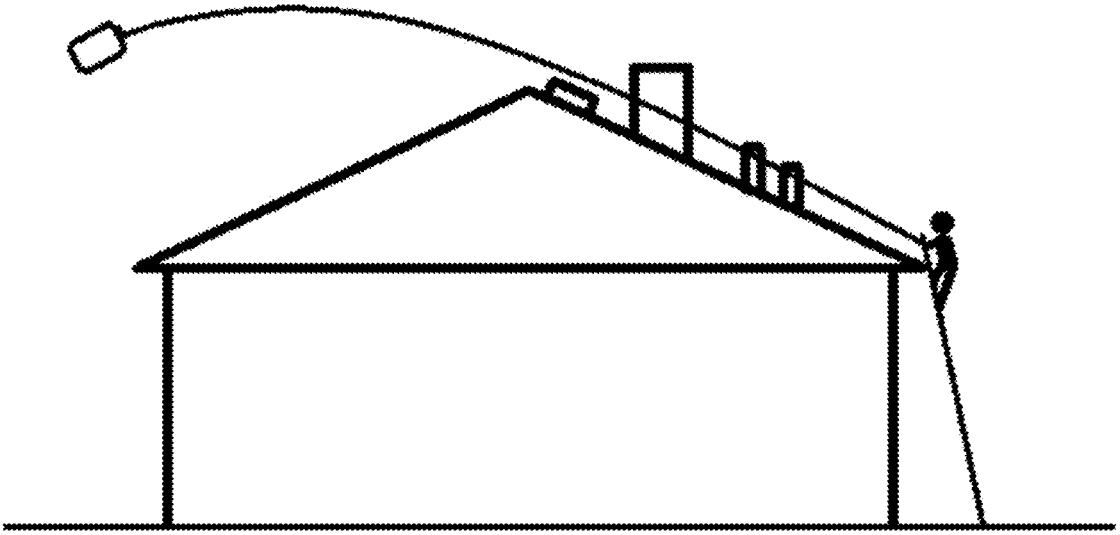
FIG. 22B is a front view showing a worker that is launching a throwline from a ladder.
Figure 22C:
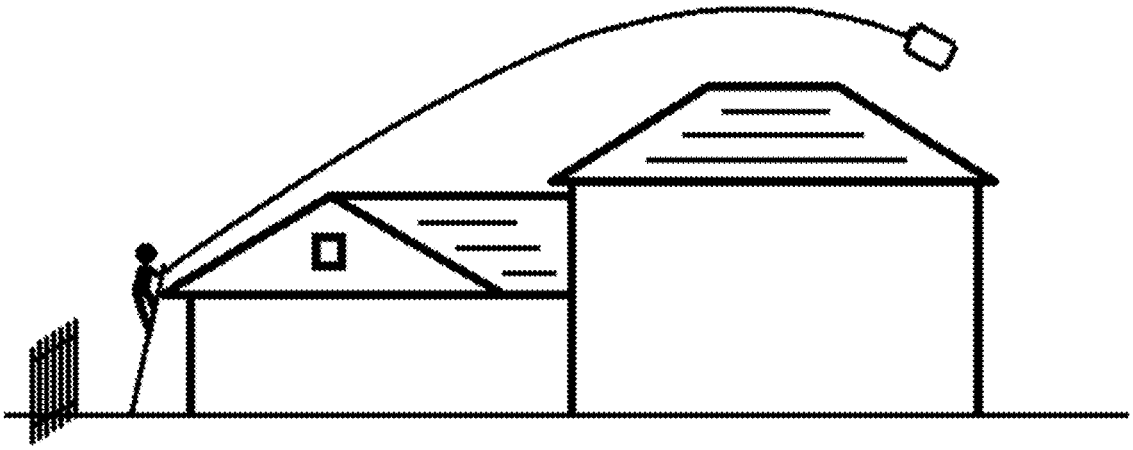
FIG. 22C is a front view showing a worker that is launching a throwline from a ladder.
Figure 22D:
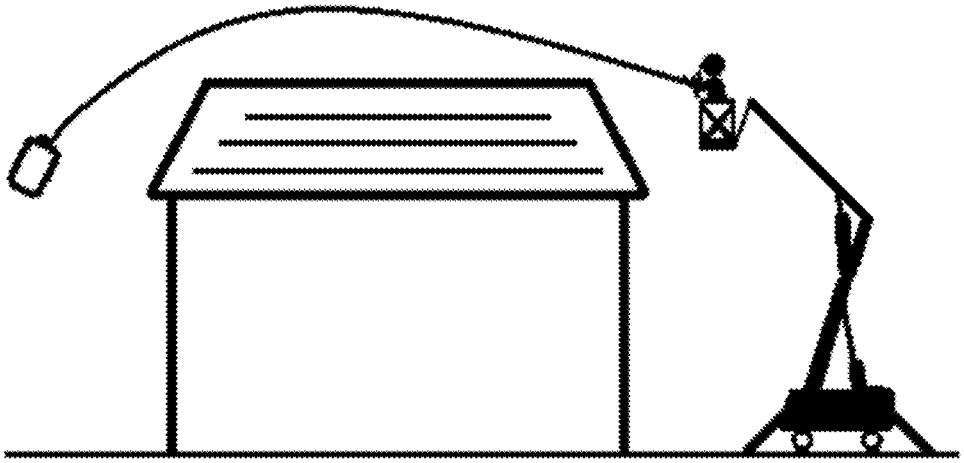
FIG. 22D is a front view showing a worker that is launching a throwline from a manlift.
Figure 23A:
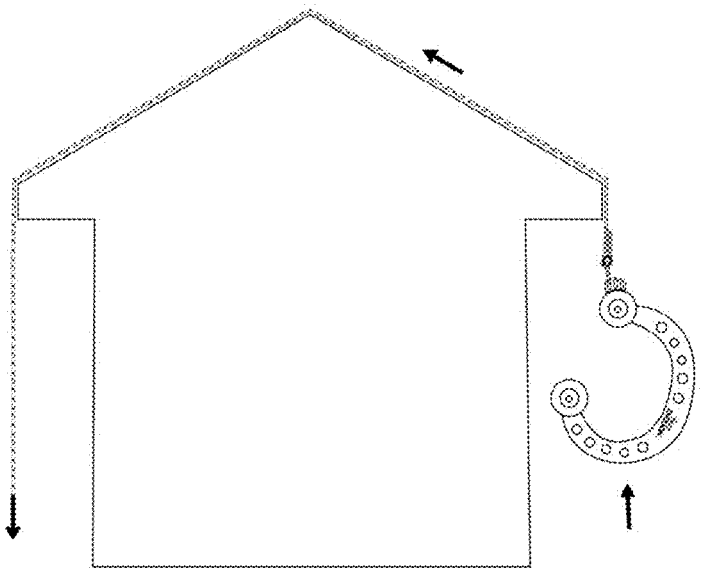
FIG. 23A is a front view showing a roof anchoring device that is connected to a tether that is across the roof and being raised as shown by the arrows.
Figure 23B:
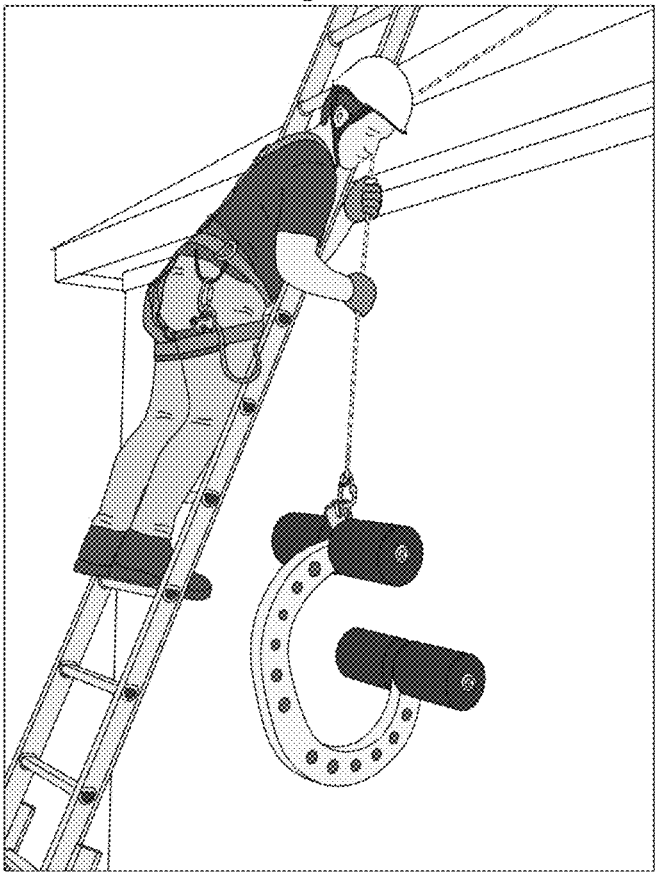
FIG. 23B is a perspective view illustrating that to raise the roof anchoring device, a worker on the ladder may lift it by the tether to which it is attached.
Figure 23C:
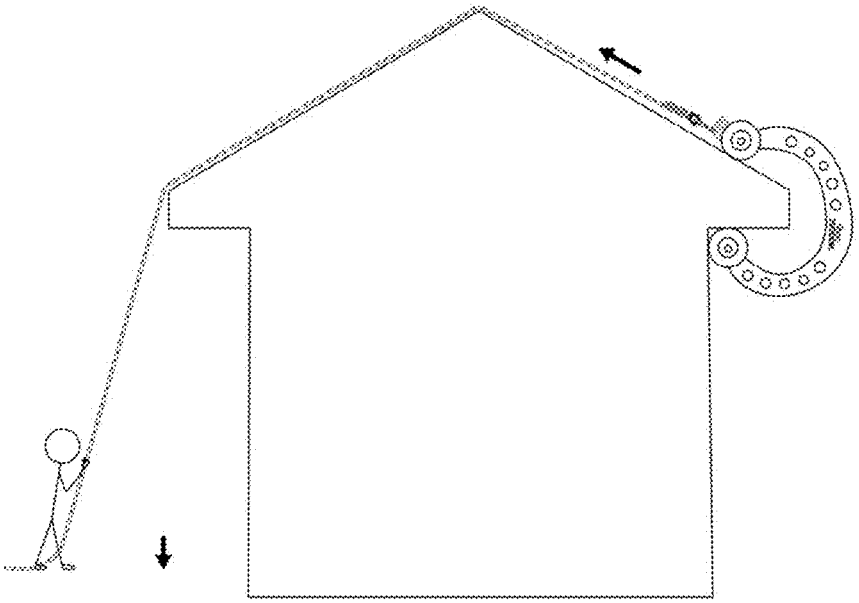
FIG. 23C is a front view showing that, from the opposite side of the roof, a worker may hold the rope to maintain the progression of the rope caused by the actions of the installer and to maintain the roof anchoring device on the roof edge.
Figure 23D:
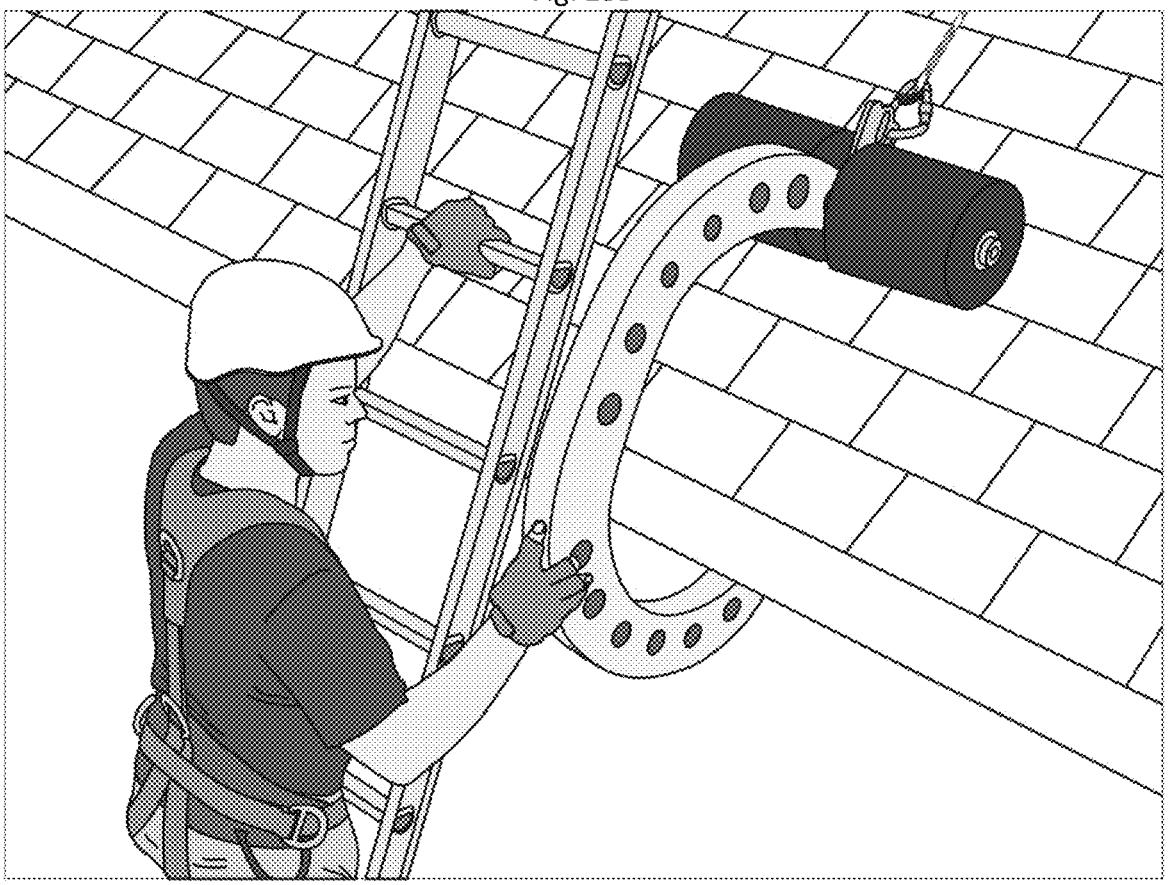
FIG. 23D is a perspective view showing that a worker may place the roof anchoring device with wheels on the roof pressing down upon the rooftop and with wheels under the roof edge that are pressing up and towards the roof.
Figure 24A:
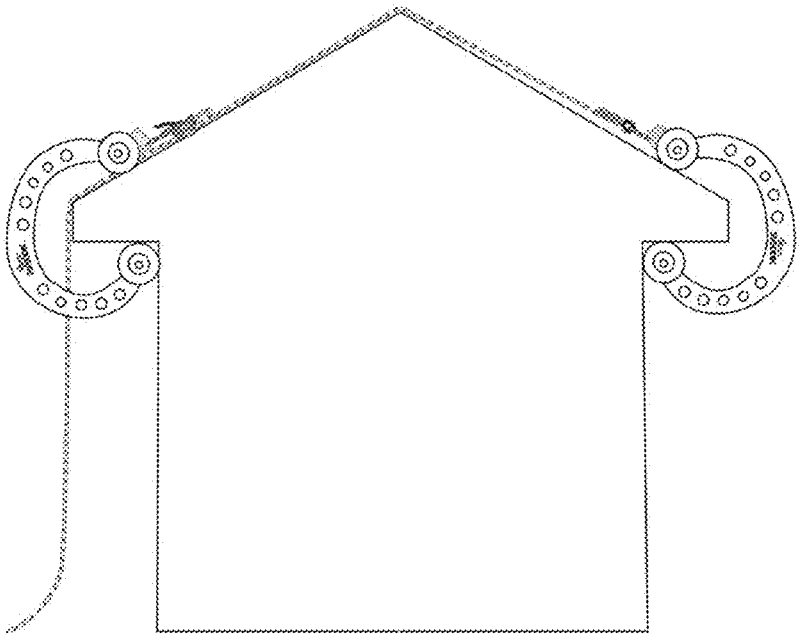
FIG. 24A is a front view showing roof anchoring devices that are attached to two sides of the roof, with a common single tensioned tether between them that is holding them to the roof edges.
Figure 24B:
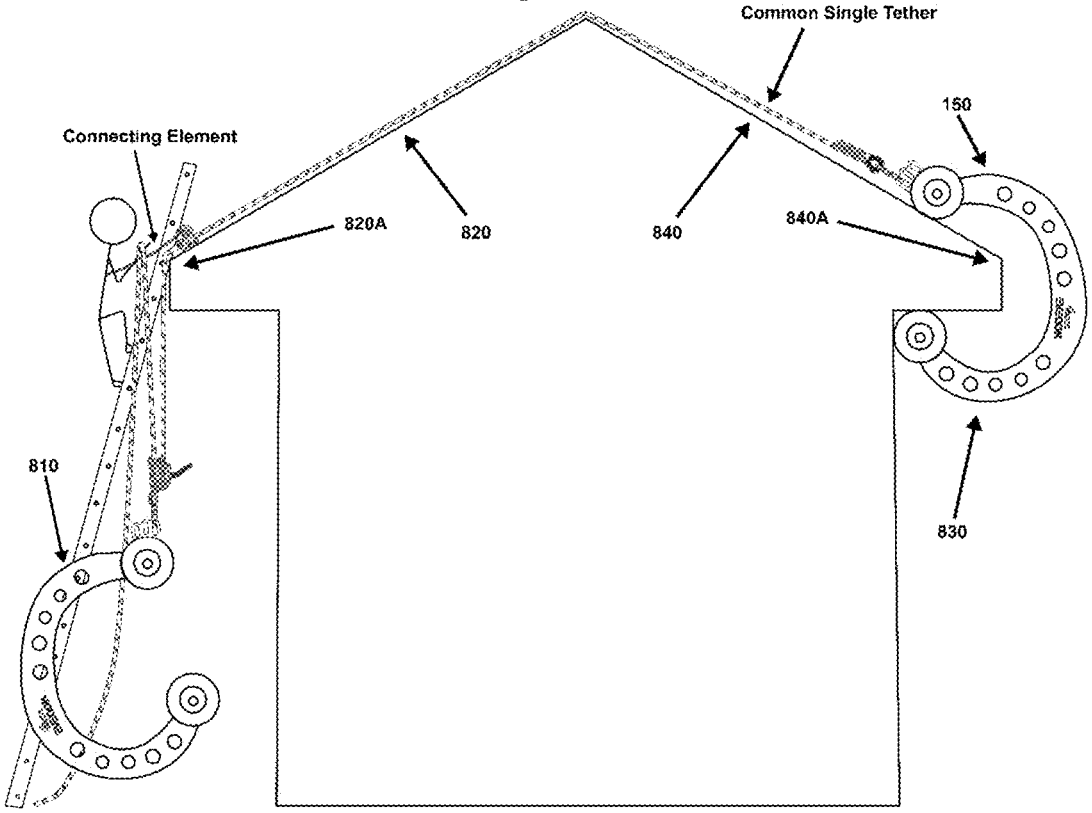
Figure 24C:
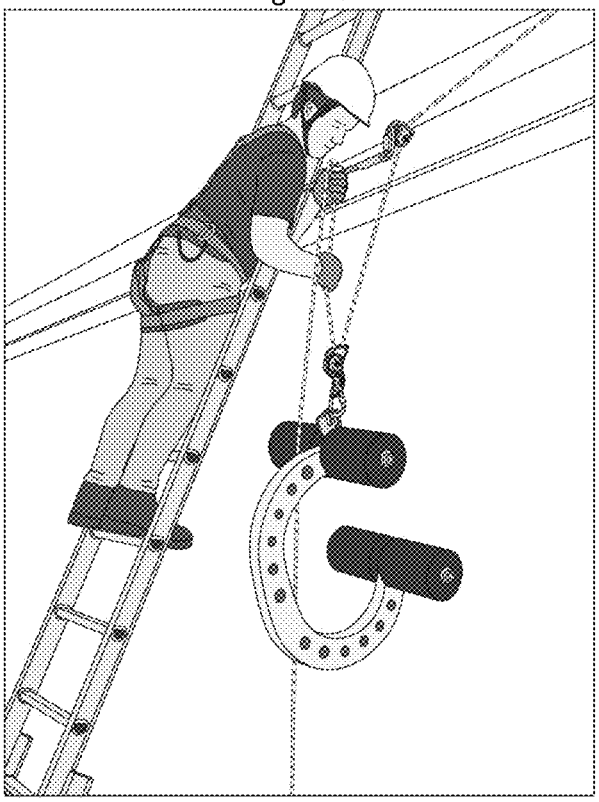

Accordingly, an embodiment of the method for installation of a roof anchor on a roof of a building may include a first person attaching a tether to the front of a first anchoring device and running the tether across the roof (FIG. 21A), possibly with the assistance of a line thrower and throw line (see, e.g., FIGS. 21B, 21C, 21D, 22A, 22B, 22C, 22D), then lifting the first anchor device, possibly with a ladder (see, e.g., FIGS. 23A, 23B) and possibly, a second person on the opposite side is supporting the roof anchoring device, keeping the rope taut and maintaining progression of the rope crossing the roof (see, e.g., FIG. 23C), positioning a first wheeled roof-anchoring device near or at a first edge of the roof (see, e.g., FIG. 23D) such that a first set of wheels with a corresponding axle are located under and in a first tensioned contact with the first edge while a second set of wheels with a corresponding second axle are in contact with and on the roof, and a first connector pivotally attached to the second axle is under tension due to a first force pulling the first connector away from the second axle up the roof, possibly from a second person on the opposite side of the roof that is pulling the tether line that is coming from the anchor device (see, e.g., FIG. 23C). (Here, the first roof-anchoring device includes a first arched body having first and second ends, the first axle with the first set of wheels juxtaposed with the first arched body at the first end, the second axle with the second set of wheels juxtaposed with the first arched body at the second end, and the first connector.) The method additionally includes disposing a second wheeled roof-anchoring device near a second edge of the roof (see, e.g., FIG. 24A), generally on the opposite side of the roof from the first edge, such that a third set of wheels with a corresponding third axle are located under and in a second tensioned contact with the second edge while a fourth set of wheels with a corresponding fourth axle are in contact with and on the roof and a second connector pivotally attached to the fourth axle is under tension due to a second force pulling the second connector away from the fourth axle, up the roof. This second anchoring device may be installed by suspending the second anchor device below the second roof edge, slightly above the ground, from the tensioned tether that is coming from the first anchor device using a progress capture pulley or similar, (see, e.g., FIG. 24B) and then lifting the anchor device with the rope and progress capture pulley or similar device (see, e.g., FIGS. 24B and 24C), maintaining tension on the tether to the first anchor device on the other side, and then disposing the second anchoring device on the edge of the second roof edge and tensioning the tether line (see, e.g., FIG. 24D). See the schematic illustrations of FIGS. 24B and 24D. (Here such second roof-anchoring device includes a second arched body having third and fourth ends, the third axle with the third set of wheels juxtaposed with the second arched body at the third end, the fourth axle with the fourth set of wheels juxtaposed with the second arched body at the fourth end, and the second connector). The first and second connectors are interconnected under constant tension with a common tether line to maintain the first and second tensioned contacts while preventing the first and third sets of wheels from losing contact with respective first and second edges of the roof. As shown in FIG. 24B, during installation of the anchoring device on the second side, the installer may attach to the common tether line with a connecting element to protect the installer from falling and to assist in maintaining tension on the common single tether line to the first anchoring device.

Figure 25A:
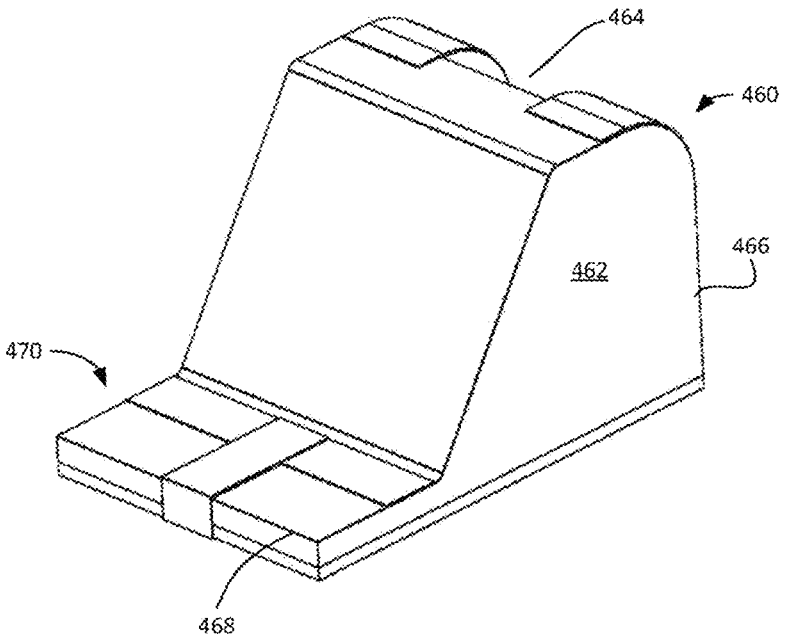
FIGS. 25A and 25B are perspective views of a stop member, used in cooperation with a roof-anchoring device such as that depicted in FIGS. 17 and 18
Figure 25B:
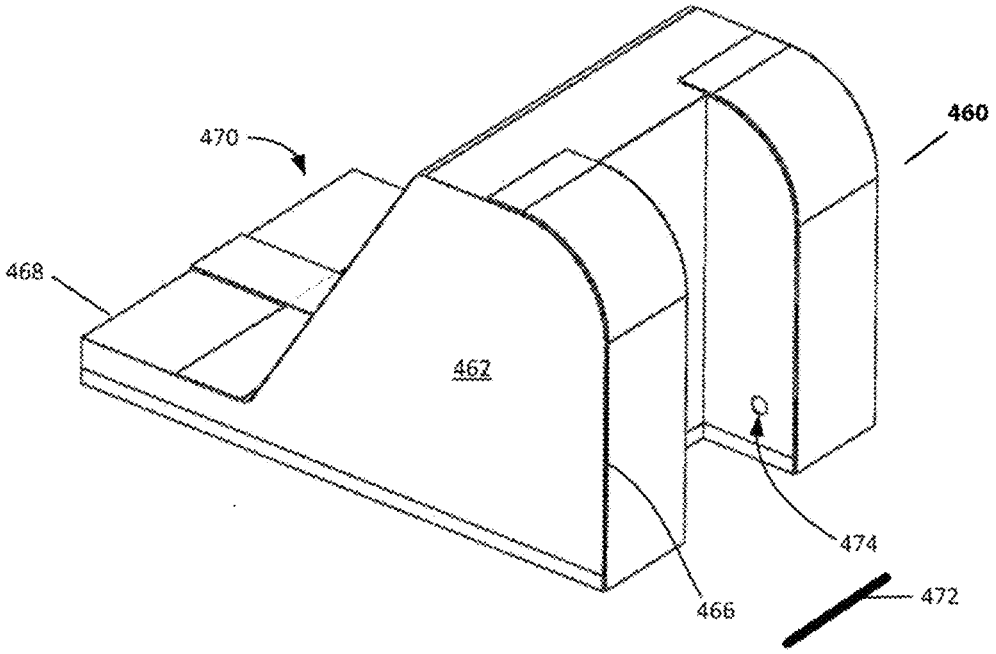

Additional embodiments of the improved roof-anchoring system may include a stopper 460, as shown in FIG. 25A, to keep a wheeled roof anchoring system 100 in place on the roof during the deployment or installation thereof. As shown in FIGS. 25A and 25B, the stopper 460 may feature a generally trapezoidal or wedge-shaped portion, 462, to wedge between the wheels of the anchoring device and the surface of the roof to prevent the mobile device from descending or rolling down the roof, in operation thereof. The stopper 460 further may feature a notch or trench 464 on a first end 466 of the stopper, and a planar or other appropriately shaped protrusion 470 at a second end 468 of the stopper, upon which the wheels of the wheeled anchor 100 may sit. In addition, a rod 472 may be used for insertion into the opening(s) 474 of the stopper, or otherwise be attached to the stopper with, for example, a clamp, and used as a handle or connection point for a tether, carabiner, snap hook or another appropriate device and/or to add counterweight (e.g., if a steel rod is used) with the use of which the stopper will be removed to free the wheels of the anchoring device. This allows a user to safely remove the stop (e.g., the user can remove the stopper while standing on the ground, next to the building).

Figure 26A:
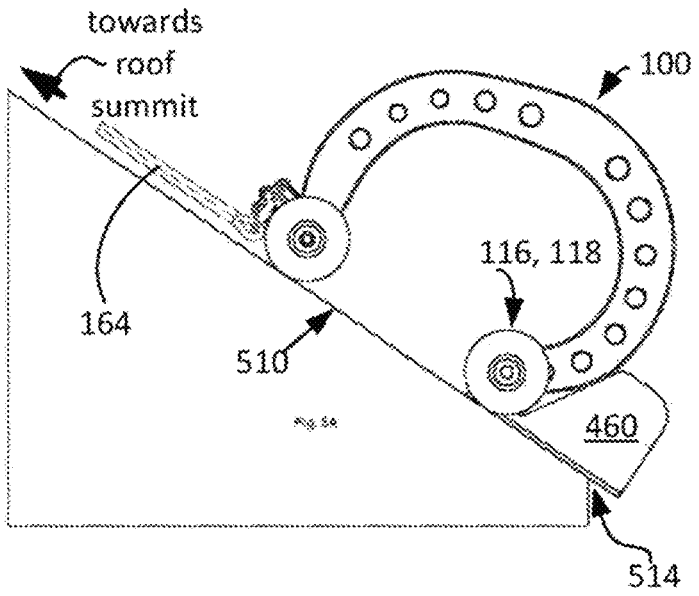
Figure 26B:
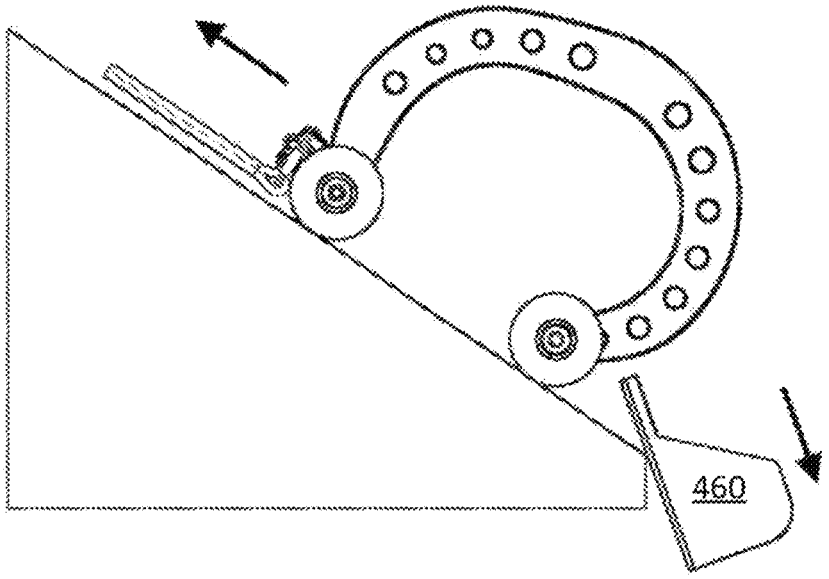
FIG. 26B illustrates a situation in which the stopper member is separating from the embodiment of the anchoring device.
Figure 26C:
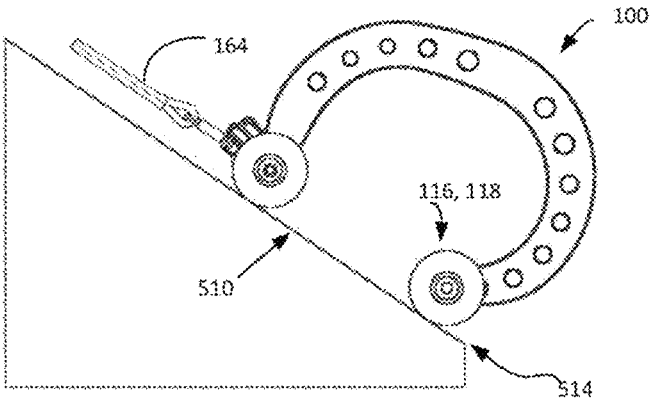
FIGS. 26C, 26D, 26E illustrate additional and/or related steps of tensioned attachment of the anchoring device in cooperation with the roof edge.

FIGS. 26A and 26B depict the use of an embodiment 460 of the stopper with an anchor 100. As shown in FIG. 26A, when the anchor or anchoring member 100 is lowered away from the summit of the roof along the slope of the roof 510 towards the edge 514, the stopper 460 is used (substantially, as a wedge element) to optionally temporarily stop the anchor 100 in a desired location before the lower wheels 116, 118 of the anchor 100 reach the edge 114. FIG. 26B illustrates the moment of "release" of the anchor 100 by, for example, pulling the tether 164 towards the summit of the roof to separate the wheels 116, 118 from contact with the stopper (and—when the stopper 460 is substantially at the edge 514 of the roof—let the stopper 460 fall from the roof). Following the release of the stopper 460 from the anchor 100 (FIG. 26C), the anchor 100 can be further lowered along the surface 510 towards the edge/eave/other structure of the roof until the lower wheels 116, 118 assume the position below the edge or eave (FIG. 26D), to position the anchoring member 100 firmly pressed to the eave/edge and under the eave/edge, as discussed in more detail below. (While the tether is shown in FIGS. 26A, 26B to be attached to the upper through-hole of the connector 150, it is understood that in some implementations it is preferred to have it attached to the lower through-hole, as is schematically shown in FIG. 26C.)

Figure 26D:
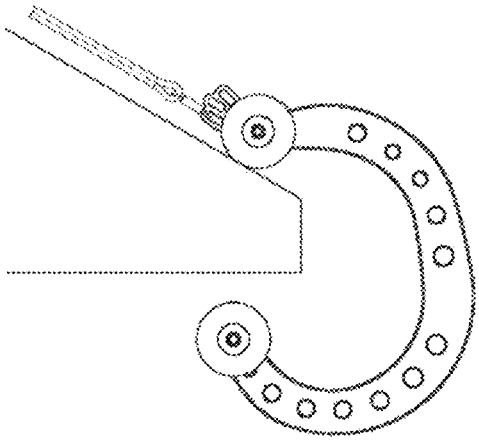
Figure 26E:
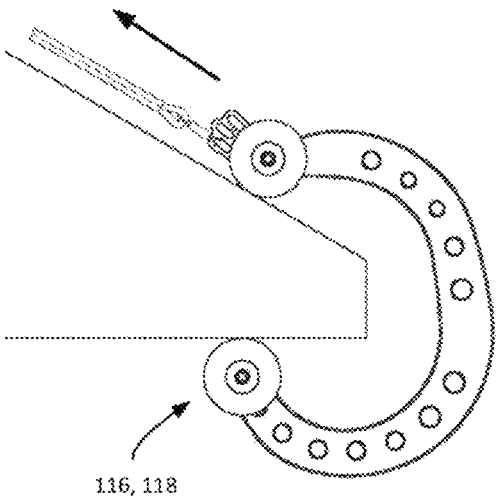

In further reference to FIGS. 17 and 18, in one implementation of the use of the anchoring device 100, after a user (not pictured) ensures that the anchoring device 100 is securely affixed to the tether line 164 (via, for example, the connector 150), the anchoring device 100 is placed on the slope of the roof to have all sets of its wheels in contact with the rooftop (FIG. 26C) and further lowered down a roof slope in a direction away from a roof ridge or peak or summit (not pictured) towards the roof edge. As the wheeled anchoring member 100 reaches the roof edge, the leading wheels 116 and 118 (located at a lower level on the roof as compared to the wheels 112, 114) drop below the roof edge (FIG. 26D). The anchoring device is then slightly raised by its tether so that the leading wheels of the anchoring device 100 that are below the roof edge are raised up and engage the soffit or under-roof surface (FIG. 26E) with the wheels 116, 118. In other words, the anchoring device 100 is further tensioned (strained) against and in contact with the roof edge as a result of pulling the anchoring device towards the roof summit so as to draw the device tightly into place, while the trailing wheels 112, 114 (at the tethered axle 120A) remain on the roof surface above the lower wheels 116, 118 now affixed in a tensioned position under the roof edge.

When used with the "stopper", a procedure of installation of the anchoring device may involve the steps of positioning a wheeled anchoring device 100 on the roof near the roof edge, with the leading wheels 116 and 118 resting upon or otherwise engaging the stopper. When the user is ready to install the device 100, wheels 116 and 118 are released or disengaged from the stopper 460, to preferably cause the stopper to fall. (A small auxiliary tether may be attached to the rod at the back of the stopper and also attached to the side of a ladder to catch the stopper, causing it to not fall to the ground.) Then, the leading wheels 116 and 118 of the device 100 may be lowered by the tether 164 and dropped below the roof edge such that the leading wheels of the anchoring device 100 hang below the roof edge to engage a soffit or under-roof surface (not pictured) with the wheels 116, 118 and further secured in the so-engaged position by pulling the tether 164 up the roof and securing the tether in a position in which the wheels 116, 118 are in tensioned contact with a surface under the edge of the roof.

Figure 27A:
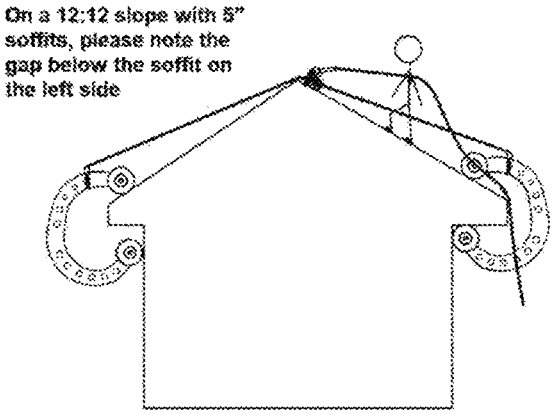
FIG. 27A, 27B, 27C show an example of operational deficiency of using an anchoring device of related art with a tether attached to the arched body of the device (instead of the connector, as per the idea of the invention). A large force, suddenly applied to the anchoring device through the attached tether or a connector and a tether to the arched body—as might be expected when a user of the anchoring device attached to eave of the roof on the side of the house opposite to a part of the roof where the user is standing—creates a non-zero torque shown to cause the anchoring device to detach from the eave and make the user lose support on the rooftop.
Figure 27B:
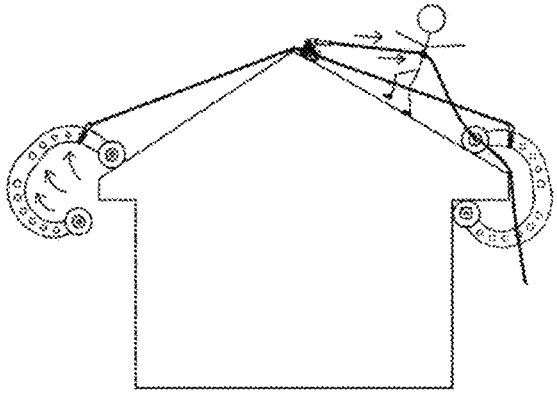
Figure 27C:
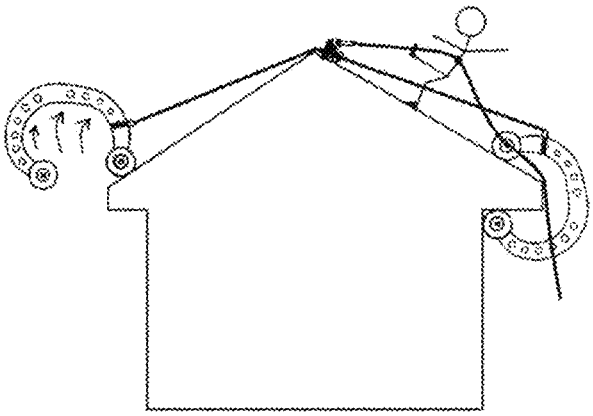

FIGS. 27A, 27B, 27C illustrate schematically an example of an anchoring device and a single tether that is attached to the body of the anchoring device, rather than the axle via the pivotal connector 150 of an embodiment of the invention. (While the tether line is illustrated to be attached at its end to the body of the anchoring device, generally it shall be attached to the corresponding pivotal connector.) A moderate to large force, suddenly applied to the anchoring device through the attached tether or a connector and a tether—as might be expected when a user of the anchoring device (attached to eave of the roof on the side of the house opposite to a part of the roof where the user is standing) stumbles or falls, creates a non-zero torque due to the non-zero spatial separation between the point of attachment of the tether and the axle of the anchoring device. This non-zero torque may separate/detach the anchoring device (on the left side of FIGS. 27A, 27B, 27C). The attachment of the tether to the pivotable connector and through it—to the axle of the anchoring device, according to the idea of the invention, avoids such possibility.

Figure 28A:
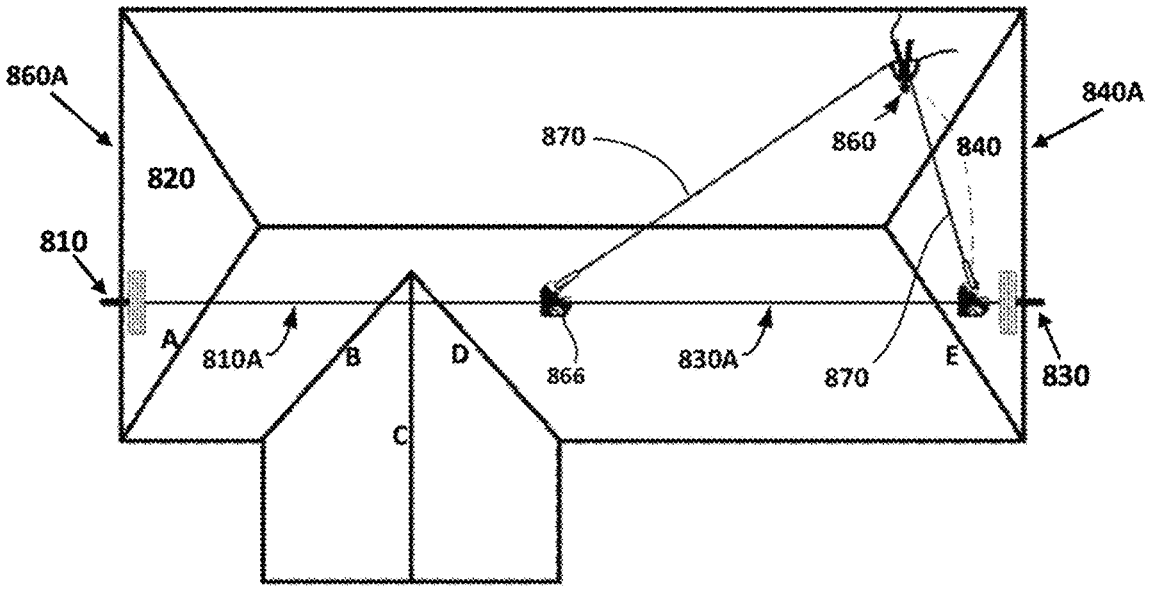
FIGS. 28A, 28B are schematic illustrations of the process for forming and maintaining a secure attachment to the rooftop of a building.
Figure 28B:
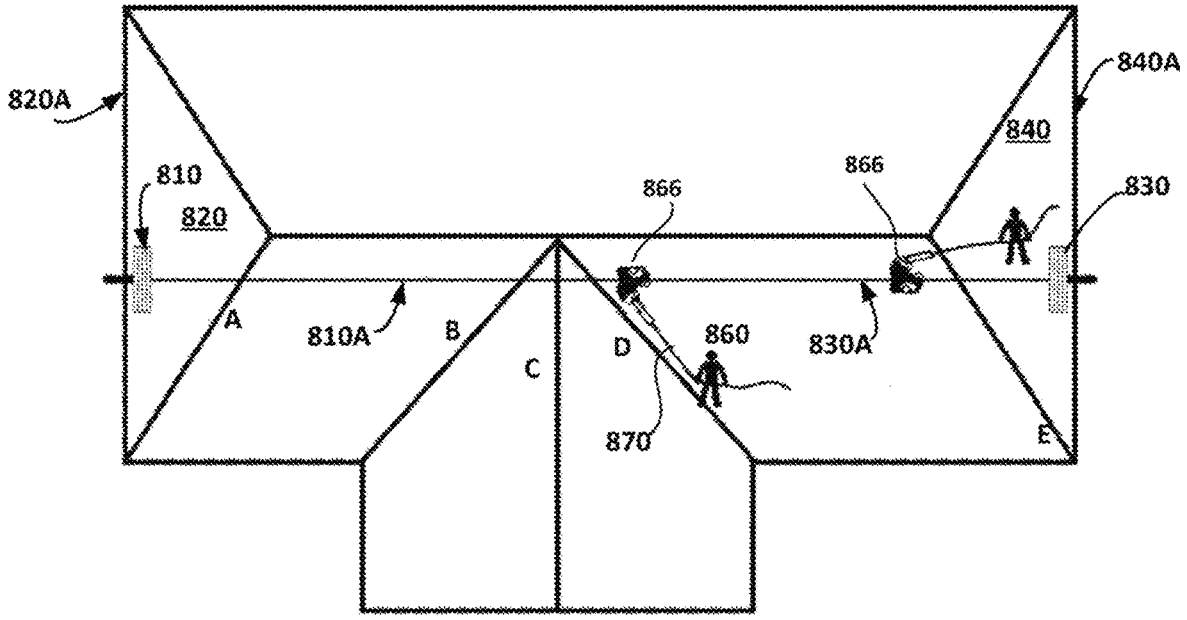

In practice, the method of forming and maintaining a secure attachment to a roof of a building includes the simultaneous use of a combination of multiple roof anchoring devices used simultaneously (at least two, possibly three or more—each may be structured according to the embodiment 100 (FIG. 17) or configured to substantially resemble it). This situation is schematically illustrated in FIG. 28B, showing (from the top) the first anchoring device 810 already secured with one axle and set of wheels under the edge 820A of the roof slope 820 and the second anchoring device 830 already secured with one axle of that system under another edge 840A of the roof slope 840. The single individual tether, labeled as 810A on one side and 830A on the other side, attached to the respectively-corresponding devices 810, 830 via corresponding connectors pivotally affixed to the front (upper) axles of the devices 810, 830—is stretched along the respectively-corresponding slopes 820, 840 and tensioned (with the use of a progress capture pulley, ratchet, or other tightening device) at the device 810 and/or the device 830. (Alternatively, 810A and 830A may be two separate tethers that are attached to the respectively-corresponding anchoring devices 810, 830 via corresponding connectors pivotally affixed to the front/upper axles of the devices 810, 830—are stretched along the respectively-corresponding slopes 820, 840 and then attached to one another with the use of a ratchet, for example to form a common tether line extending from the device 810 to the device 830.) This tether line is formed under tension sufficient to maintain each of the devices 810, 830 in their respective positions without having the devices substantially moving away from the respective edges with respect to the edges 820A, 840A even if a sufficient force were to be applied to at least one of the devices 810, 830. (As shown, the single tether line 810A, 830A or common tether line formed by individual tethers 810A, 830A is passed over the multiple rooftop edges —shown in this example as A, B, C, D, E—while not being attached to any roof fixture, outside of the roof anchoring devices). The so-attached/interconnected and stretched about the roof combination of the first and second anchors 810, 830 is configured, therefore, to allow the user 860 to movably affix himself, with the use of appropriate gear and harness—such as that including a rope grab(s), carabiner(s), snap hook(s), ring(s), tether(s) or other similar devices—to the common tether line 810A/830A, to be able to slidably reposition said appropriate gear and harness over and along the single or common tether line 810A/830A from substantially every point of the single or common tether line to every other point of the common tether line and to anchor along the same tether line at substantially every point of the single or common tether line, therefore, to move about the roof while being secured from a fall, by the system anchored by 810, 830, interconnected to one another by the strained single or common tether line 810A/830A.

As illustrated in the specific example FIG. 28B, for example, at least one of a connecting element or elements, which may include at least one tether line(s), between a user's harness 860 and the common single tether line (810A, 830A) to permit anchoring and sliding. Anchoring may include anchoring of the respective element at any point along the common single tether line, any point defined between the connectors of the first and second roof-anchoring devices. Sliding may include sliding of the respective element over and along the common single tether line from every first point of the common single tether line to every second point of the common single tether line, both the first point and the second point defined between the connectors of the first and second roof-anchoring devices. Passing through and/or attached to the belt or harness of the user 860, the said connecting element may be slidably or fixably attached to the harness.

In another example, the lifeline 870 passing through and/or attached to the belt or harness of the user 860 is slidably attached via some combination of a lanyard, lifeline, strap or other type of line and a slidable device(s) such as a rope grab, carabiner, snap hook, ring or other similar device 866 to the common tether 810A, 830A at the lifeline to the tether or the harness to the lifeline. Alternatively, in a related embodiment, the attachments 866 may be sufficiently fixed.

A person of skill will readily appreciate that formation of the common tether line as discussed results in a situation where the used anchoring device 830 is prevented from moving away from the corresponding edges of the roof primarily by the tensioned contact of the anchoring device 810 with the edge 820A of the roof, while the anchoring device 810 is prevented from moving away from the edge 820A of the roof primarily by the tensioned contact of the anchoring device 830 with the edge 840A of the roof. Furthermore, the user 860 is enabled to move about the roof while connected to the tether line or common tether line via the device 866. Notably, with only one lifeline attached to one tether, if a user moves too close to a corner such person is at risk of falling because he/she can only be completely prevented from falling off of 1 of the 2 edges that are on either side of the corner. However, if a person anchors one lifeline to the common single tether, at or near the anchoring device that is closest to the corner, and anchors a second lifeline to the same tether line or common tether line at a distance away from the anchorage of the first lifeline, the person can be protected from falling from the roof edges on both sides of the corner so they can get much closer to the corner with fall protection. FIG. 28A schematically illustrates a secure attachment to the roof similar to that of FIG. 28B, but in which two persons are attached to one common single tether line. FIG. 28A illustrates a person using two lifelines instead of one, to better prevent a fall while working near a corner.

Figure 24D:
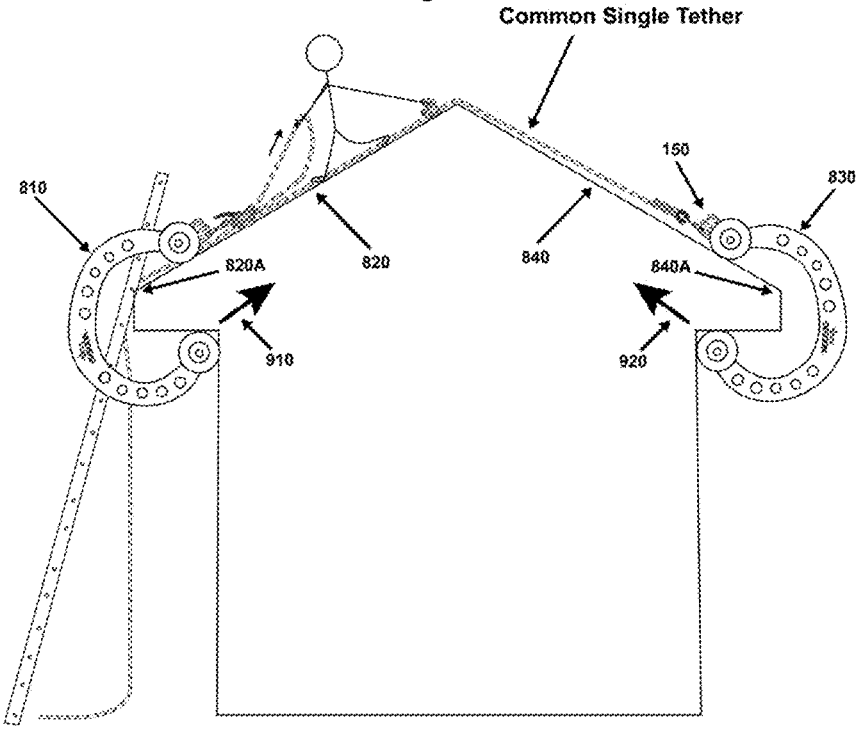
FIG. 24D is a front view showing a worker that is tensioning a second roof anchoring device to the roof edge with the common tether line, and by doing so both roof anchoring devices are tensioned to the roof and also the tether line between the two anchoring devices is tensioned. This also provides a simplified schematic in support of the process described in reference to FIGS. 28A, 28B: standard attachment of an additional anchor device on the second side of the roof with the use of a progress capture type device and utilizing a single tether.

As an additional illustration, the schematic version of the combination of the already connected to one another systems 810, 830 is shown in FIG. 24D where the arrows 910, 920 illustrate the tension force(s) with which the lower set of wheels with corresponding axles of the systems 810, 830 are substantially unmovably pressed to the under-surface of the roof below the corresponding edges 820A, 840A, with the tether tensioned and attached to the anchoring devices.

Notably, certain further improvements to the methodology for forming and maintaining a secure attachment to the roof are envisioned and remain within the scope of the invention. Among them—in reference to FIG. 29A, for example, showing schematically a top view of the roof with edges 1010, 1014, 1018, 1022—there is the use of a system in which, in addition to the tether line 1030 tensionably connecting the opposing anchoring devices 1034, 1038 that are substantially immovably affixed to and under the edges 1010, 1014 (as discussed above); at least one additional anchoring device is used (as shown—two devices, 1042 and 1046) that, with the use of its respective tether or support lines (here—1050, 1054) is also affixed under tension to the roof edge (1018, 1022) and substantially to the major, common single tether line 1030 at a point between the ends of the common single tether line (here—points 1060, 1064) such that the corresponding support lines and the main, common single tether line are transverse to one another. In a specific example, the attachment between a given support line and a tether line 1030 can be structured with the use of a component referred to in the art as a "Goblin", or a device similar to it. (The Goblin will only travel freely substantially in one direction, and in the current configuration, 1060 and 1064 they will only travel substantially towards each other, in other words they are substantially immobile unless manually caused to go in the opposite directions with constant and intentional action on the device, from the user.) When two or more so-structured connecting lines (1050, 1054) are present, the connecting points 1060, 1064 can be chosen far apart from one another (substantially anywhere between the ends of the tether 1030 corresponding to the anchors 1034, 1038) or close to one another (as shown). (As shown, with two supporting tensioned tether lines from the common single tether line 1030 to the anchor device 1042, and the common single tether line 1030 to the anchor device 1046, the supporting tether line 1050 is much more stable, since the supporting tether line 1054 will prevent the common single tether line 1030 from sagging, and the person 860 is better protected than if the tether line from 1030 to 1046 was not included.) Other perspectives of FIG. 29A may include FIGS. 29B and 29C.

This additional arrangement of the combination of the main tether line with at least one support line (see, e.g., FIG. 29A) facilitates an additional degree of freedom as far as attachment of the user at the rooftop is concerned. Specifically, the user 860, located on the roof somewhere in the area limited by the edges 1014, 1018 and the support line 1050 and the tether line 1030, is now in a position to use a predefined connecting element or elements, which may include at least one tether line 1030, to moveably affix the harness the user is wearing to both the support line 1050 and the tether line 1030—thereby gaining the ability to move anywhere in the identified area and approach the corner of the roof at the intersection of edges 1014, 1018 without the risk of falling off the roof. Alternatively or in addition, at least one of the mechanical connections between the user's harness and the lines 1030, 1050 (in this example) can be an anchored—that is, substantially immovable—connection.

Added tethers from auxiliary anchoring devices may be used to increase the safe area on the roof for the user and reinforce the existing tensioned tether line(s) (see, e.g., FIGS. 9, 10, 11, 29A). (For example, to reinforce a tensioned common single tether line from sagging, a person with a 200-foot common single tensioned tether line, halfway between the two anchoring devices may attach a tensioned supporting tether line to the original common single tether line, such supporting tether line is attached preferably substantially perpendicular to the original tensioned tether line and attaches to an anchorage at the roof edge, where the roof edge is nearly parallel to the original tether. This supporting tether reinforces the original tether for a person that is attached to the original tether and is on the roof on the opposite side of the roof from the supporting tether. To reinforce the original tensioned tether on both sides of the roof, a tensioned tether shall be attached to both sides of the original tether.

Figure 30A:
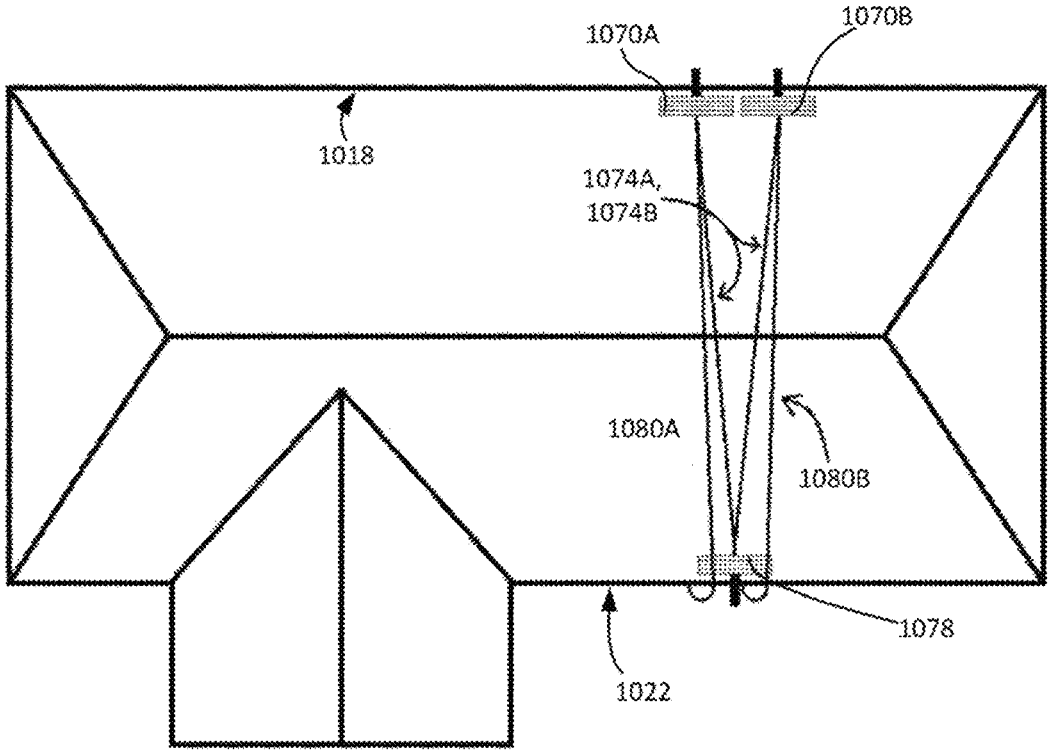
FIGS. 30A, 30B show additional perspectives of non-limiting related implementations of the secure attachment to the rooftop.
Figure 30B:
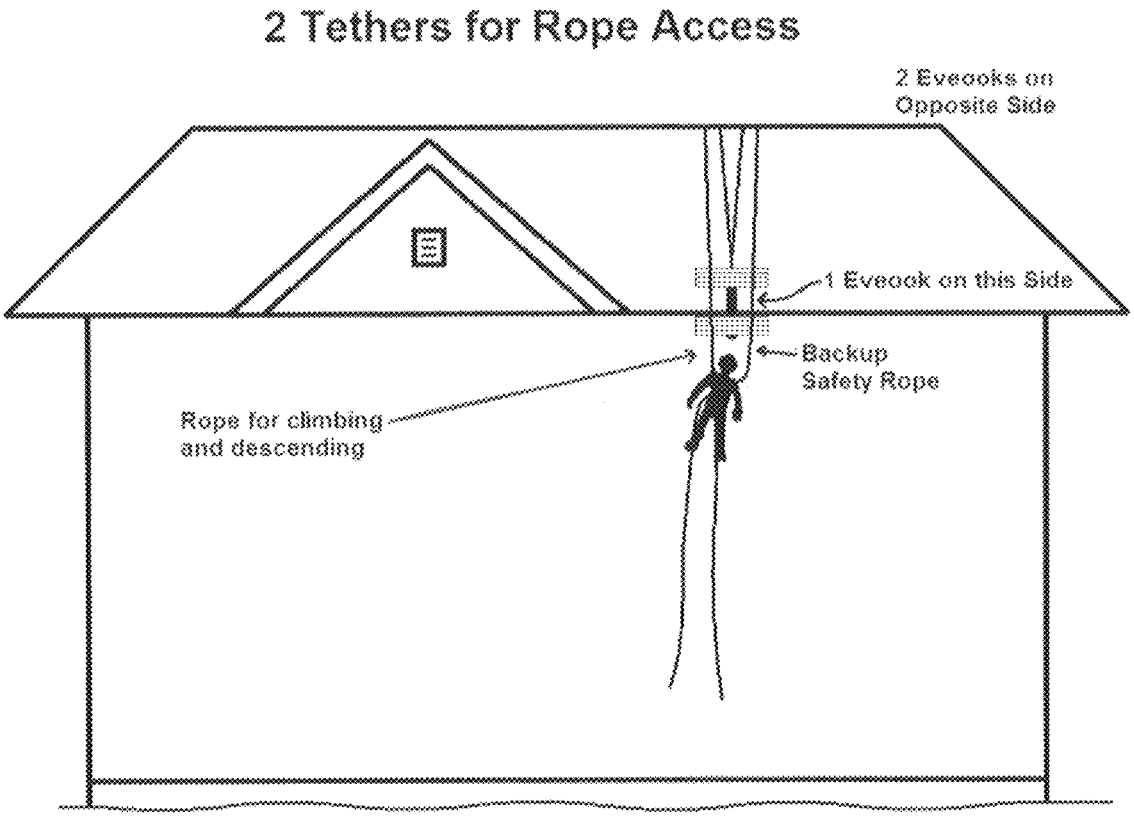

Yet another related non-limiting implementation is schematically shown in FIG. 30A, in which two anchoring devices 1070A, 1070B juxtaposed in cooperation with the same roof edge 1018 are tensioned (via two tethers 1074A, 1074B) against the anchoring device 1078 juxtaposed in cooperation with the opposite roof edge 1022. 1080A, 1080B illustrate back-up safety ropes and/or ropes for ascending/descending from, to, or along the roof, which would include the example shown in FIG. 30B, a continuation of FIG. 30A, where a worker is suspended from one rope and is using another rope as backup in case the connection to the first rope fails.

It should be evident that the improved roof-anchoring device 100, the overall anchoring system (such as that described in reference to FIGS. 28A, 28B or FIGS. 24A, 24B, 24C, 24D, for example) and any components disclosed herein may be fabricated or formed in a variety of ways and from a variety of materials. The various parts may be machined, molded or otherwise fabricated from high strength materials such as steel, aluminum alloy, reinforced aluminum, tubular alloy, high-strength plastics or wood, or be manufactured from a combination of any suitable materials and processes. The choice of materials and construction are clearly within the scope of the appended claims. A skilled artisan will readily appreciate that embodiments of the invention—as illustrated, for example, in connection with FIG. 28B—provide a clear advantage in exploitation of the embodiment. Specifically, on the tether line 810A/830A, tensioned between the connection of the roof anchoring devices 810 and 830, the rope grab or similar device 866, that is repositionable substantially from every point on the common tether line to every other point of the common tether line as an anchorage for the tether lines (lifelines) to the user, may provide the safety feature shown in illustration 28A, where the user is prevented from falling from either side of the corner that is within his closest proximity.

References made throughout this specification to "one embodiment," "an embodiment," "a related embodiment," or similar language mean that a particular feature, structure, or characteristic described in connection with the referred to "embodiment" is included in at least one embodiment of the present invention. Thus, appearances of these phrases and terms may, but do not necessarily, refer to the same implementation. It is to be understood that no portion of disclosure, taken on its own and in possible connection with a figure, is intended to provide a complete description of all features of the invention.

It is also to be understood that no single drawing is intended to support a complete description of all features of the invention. In other words, a given drawing is generally descriptive of only some, and generally not all, features of the invention. A given drawing and an associated portion of the disclosure containing a description referencing such drawing do not, generally, contain all elements of a particular view or all features that can be presented is this view, for purposes of simplifying the given drawing and discussion, and to direct the discussion to particular elements that are featured in this drawing. A skilled artisan will recognize that the invention may possibly be practiced without one or more of the specific features, elements, components, structures, details, or characteristics, or with the use of other methods, components, materials, and so forth. Therefore, although a particular detail of an embodiment of the invention may not be necessarily shown in each and every drawing describing such embodiment, the presence of this detail in the drawing may be implied unless the context of the description requires otherwise. In other instances, well known structures, details, materials, or operations may be not shown in a given drawing or described in detail to avoid obscuring aspects of an embodiment of the invention that are being discussed.

The invention as recited in claims appended to this disclosure is intended to be assessed in light of the disclosure as a whole, including features disclosed in prior art to which reference is made.

While the description of the invention is presented through the above examples of embodiments, those of ordinary skill in the art understand that modifications to, and variations of, the illustrated embodiments may be made without departing from the inventive concepts disclosed herein. The invention should not be viewed as being limited to the disclosed examples.

The invention claimed is:

1. A method for forming and using a secure non-penetrating roof anchoring system capable of use with sloped rooftops of a building having a common single tether line positioned across a roof of the building to be connected to a first roof-anchoring device and a second roof-anchoring device, the method comprising:

positioning the first roof-anchoring device, without penetrating the roof or the building, at or near a first edge of the roof such that a first axle on the first roof-anchoring device is located under and pressing toward the first edge while a second axle on the first roof-anchoring device is pressing toward the roof and a first connector pivotally attached to the second axle is under tension due to a first force applied via the common single tether line pulling said first connector away from the second axle up the roof, wherein said first roof-anchoring device includes a first arched body having first and second ends, the first axle juxtaposed with the first arched body at the first end, the second axle juxtaposed with the first arched body at the second end, and said first connector;

disposing a second roof-anchoring device near a second edge of the roof such that a third axle on the second roof-anchoring device is located under and pressing toward the second edge while a fourth axle on the second roof-anchoring device is above and pressing toward the roof and a second connector pivotally attached to the fourth axle is under tension due to a second force applied via the common single tether line pulling said second connector away from the fourth axle up the roof, wherein said second roof-anchoring device includes a second arched body having third and fourth ends, the third axle juxtaposed with the second arched body at the third end, the fourth axle is juxtaposed with the second arched body at the fourth end, and said second connector;

wherein said first and second connectors are linked with the common single tether line under strain configured to maintain the first and second forces while preventing said first and third axles from moving away from first and second edges of the roof;

wherein said positioning the first roof-anchoring device step includes (1) locating the first roof-anchoring device on the roof such that wheels on the first and second axles are adjacent to and in contact with the rooftop and (2) causing said first roof-anchoring device to lower to the first edge of the roof, at least until the wheels of said first axle lose contact with the roof; and wherein said locating includes (1) placing a stopper on the rooftop between the first edge and the first axle closest to the first edge and (2) engaging at least one wheel supported on said first axle closest to the first edge with the stopper to prevent further movement of the first roof-anchoring device towards the first edge.

2. The method according to claim 1, wherein said disposing the second roof-anchoring device includes disposing the second roof-anchoring device near or at the second edge that is opposite to the first edge.

3. The method according to claim 1, wherein said positioning the first roof-anchoring device further includes:

suspending said wheels of the first roof-anchoring device beneath the roof from the tether and repositioning said first roof-anchoring device upward towards the roof until the second axle, to which the first connector is attached, is positioned above said first edge of the roof while the wheels of the first axle opposite to said first connector is pressed towards and under an eave of the roof at the first edge of the roof.

4. The method according to claim 1, wherein disposing of the second roof-anchoring device further comprises suspending said second roof-anchoring device below said second roof edge from the common single tether line and repositioning said second roof-anchoring device upward towards the roof, while maintaining tension in the common single tether line, until the fourth axle to which the second connector is attached is positioned above said second edge of the roof while the third axle, opposite to said second connector, is pressed towards and under the roof at the second edge of the roof.

5. The method according to claim 1, further comprising disengaging said at least one wheel of the first roof-anchoring device from said stopper disposed below or under said first axle of the first roof-anchoring device to cause said stopper to fall from said first edge of the roof.

6. The method according to claim 1, further comprising configuring said common single tether line such that the preventing said first axle from moving relative to the first edge of the roof is caused primarily by tensioned contact of wheels of the third axle with the second edge of the roof, and the preventing said third axle from moving relative to the second edge of the roof is caused primarily by tensioned contact of wheels of the first axle with the first edge of the roof.

7. A method for forming a secure attachment to a roof of a building, the method comprising:

running a common single tether line across the roof;

positioning a first roof-anchoring device at or near a first edge of the roof such that a first axle of the first roof-anchoring device is located under and in a first tensioned contact with the first edge while a second axle of the first roof-anchoring device is on the roof and a first connector pivotally attached to the second axle is under tension due to a first force applied via the common single tether line pulling said first connector away from the second axle up the roof, wherein said first roof-anchoring device includes a first arched body having first and second ends, the first axle juxtaposed with the first arched body at the first end, the second axle juxtaposed with the first arched body at the second end, and said first connector;

disposing a second roof-anchoring device near a second edge of the roof such that a third axle of the second roof-anchoring device is located under and in a second tensioned contact with the second edge while a fourth axle of the second roof-anchoring device is in contact with and on the roof and a second connector pivotally attached to the fourth axle is under tension due to a second force applied via the common single tether line pulling said second connector away from the fourth axle up the roof, wherein said second roof-anchoring device includes a second arched body having third and fourth ends, the third axle juxtaposed with the second arched body at the third end, the fourth axle is juxtaposed with the second arched body at the fourth end, and said second connector;

wherein said first and second connectors are linked with the common single tether line under strain configured to maintain the first and second tensioned contacts while preventing said first and third axles from moving away from first and second edges of the roof; and disengaging at least one of the first and second roof-anchoring devices from a stopper disposed below or under the first axle of the first roof-anchoring device or the third axle of the second roof-anchoring device to cause said stopper to fall from the first or the second edge of the roof.

8. The method according to claim 1, further comprising attaching at least one connecting element or elements between a user's harness and said common single tether line to permit anchoring and sliding, wherein:

anchoring comprises anchoring of the respective at least one element or elements at any point along the common single tether line, any point defined between the connectors of the first and second roof-anchoring devices; and sliding comprises sliding of the respective at least one element or elements over and along the common single tether line from every first point of the common single tether line to every second point of the common single tether line, both the first point and the second point defined between the connectors of the first and second roof-anchoring devices.

9. The method according to claim 1, comprising:

positioning a third roof-anchoring device at or near a third edge of the roof such that a fifth axle on the third roof-anchoring device is located under and pressing towards the third edge while a sixth axle on the third roof-anchoring device is above and pressing towards the roof and a third connector pivotally attached to the sixth axle is under tension due to a third force pulling said third connector away from the sixth axle up the roof, wherein said third roof-anchoring device is substantially equivalent to the first roof-anchoring device, and wherein the third force is caused as a result of tensioned attachment of the third connector of the third roof-anchoring device to the common single tether line at a support point between the first and second roof-anchoring devices with the use of a support line, said support line being transverse to the common single tether line.

10. The method according to claim 1, further comprising attaching a first connecting element or elements between a user's harness and said common single tether line, and attaching a second connecting element or elements between the user's harness and a support line to permit anchoring and sliding a) sliding of said first connecting element or elements over and along the common single tether line from every point of the common single tether line to every other point of the common single tether line between an end of the common single tether line and a support point, and anchoring the first connecting element or elements on the common single tether line at any point between the end of the common single tether line and the support point; and b) sliding of said second connecting element or elements over and along the support line from every point of the support line to every other point of the support line between an end of the support line and the support point, and anchoring the second connecting element or elements on the support line at any point between the end of the support line and the support point.

11. The method according to claim 1, further comprising:

attaching a first connecting element or elements between a user's harness and a second connecting element or elements to permit anchoring and sliding:

anchoring of the first connecting element or elements at any point along the second connecting element or elements, and sliding of the first connecting element or elements over and along the second connecting element or elements from every first point of the second connecting element or elements to every second point of the second connecting element or elements, and attaching the second connecting element or elements to said common single tether line or to a support line to permit anchoring and sliding of the second connecting element or elements:

anchoring of the second connecting element or elements at any point along the common single tether line, any point along the common single tether line defined between the connectors of the first and second roof-anchoring devices, or at any point along the support line, any point along the support line defined between a third connector of a third roof-anchoring device and a support point where the support line is attached to the common single tether line, and sliding of the second connecting element over and along the common single tether line from every first point of the common single tether line to every second point of the common single tether line, both the first point and the second point defined between the connectors of the first and second roof-anchoring devices, or sliding of the second connecting element over and along the support line from every first point of the support line to every second point of the support line, both the first point and the second point of the support line defined between the third connector of the third roof-anchoring device and the support point where the support line is attached to the common single tether line.

12. The method according to claim 1, further comprising:

attaching an end of the common single tether line to the second roof-anchoring device with a capture device while maintaining tension on the common single tether from the first edge of the roof; and lifting the second roof-anchoring device to the second edge while maintaining said tension.

13. The method according to claim 1, wherein at least one of said positioning and disposing includes pivoting at least one of the first connector with respect to the second axle and the second connector with respect to the fourth axle.

14. The method according to claim 1, wherein the common single tether line is positioned across the roof with use of a line thrower and a throw line.

* * * * *